US008378823B2

(12) United States Patent
Eckert et al.

(10) Patent No.: US 8,378,823 B2
(45) Date of Patent: Feb. 19, 2013

(54) TRANSMIT-ONLY ELECTRONIC ARTICLE SURVEILLANCE SYSTEM AND METHOD

(75) Inventors: Lee Eckert, Waxhaw, NC (US); Brian Vincent Conti, Matthews, NC (US); Gary Mark Shafer, Charlotte, NC (US); Brian Wiese, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 480 days.

(21) Appl. No.: 12/771,510

(22) Filed: Apr. 30, 2010

(65) Prior Publication Data

US 2010/0277322 A1 Nov. 4, 2010

Related U.S. Application Data

(60) Provisional application No. 61/174,734, filed on May 1, 2009.

(51) Int. Cl.
*G08B 13/14* (2006.01)

(52) U.S. Cl. ..... 340/571; 340/572.1; 340/572.4; 340/572.7; 340/572.8; 340/686.6

(58) Field of Classification Search ..... 340/571, 340/572.1, 572.4, 572.7, 572.8, 686.6, 10.1, 340/10.3, 10.4
See application file for complete search history.

(56) References Cited

U.S. PATENT DOCUMENTS

| | | | | |
|---|---|---|---|---|
| 4,692,747 | A | 9/1987 | Wolf | |
| 4,831,363 | A | 5/1989 | Wolf | |
| 4,851,815 | A | 7/1989 | Enkelmann | |
| 6,720,930 | B2 * | 4/2004 | Johnson et al. | 343/742 |
| 6,911,908 | B1 * | 6/2005 | Beart | 340/571 |
| 7,474,215 | B2 | 1/2009 | Scott et al. | |
| 7,538,680 | B2 | 5/2009 | Scott et al. | |
| 7,663,489 | B2 | 2/2010 | Scott et al. | |
| 8,193,935 | B2 * | 6/2012 | Gates | 340/545.1 |
| 2001/0000019 | A1 * | 3/2001 | Bowers et al. | 340/572.1 |
| 2004/0212500 | A1 * | 10/2004 | Stilp | 340/541 |
| 2004/0233042 | A1 | 11/2004 | Piccoli et al. | |
| 2006/0026797 | A1 | 2/2006 | Coyle | |
| 2006/0082510 | A1 * | 4/2006 | Eckstein et al. | 343/720 |
| 2008/0117029 | A1 * | 5/2008 | Dohrmann et al. | 340/286.02 |
| 2009/0243837 | A1 * | 10/2009 | Chul Lee et al. | 340/531 |

FOREIGN PATENT DOCUMENTS

| | | |
|---|---|---|
| DE | 19822670 | 11/1999 |
| GB | 2137391 | 10/1984 |
| GB | 2205426 | 12/1988 |
| WO | 2007/115097 | 10/2007 |

* cited by examiner

*Primary Examiner* — Jennifer Mehmood
*Assistant Examiner* — Andrew Bee
(74) *Attorney, Agent, or Firm* — Sand & Sebolt

(57) ABSTRACT

An anti-theft security system that utilizes an electronic article surveillance (EAS) beacon that emits an electromagnetic field that a corresponding security tag transponder detects in determining whether to set off onboard transponder alarms or to remain dormant. The EAS beacon is a self-contained beacon that can be easily installed at any desired location and can utilize local utility power or revert to battery power. Among other things, this avoids the large installation, calibration and maintenance costs and tasks of conventional EAS pedestals. The EAS beacon includes coil panels that are secured to an elongated housing that can be flexed to avoid or minimize damage should something or someone come into contact with the panels. An audible/visible alarm is activated when such flexing or tampering occurs. A passive infrared detector is provided to reduce power consumption when the EAS beacon is operating on battery power. The EAS beacon may also be used in existing EAS and RFID anti-theft security systems wherein the associated security transponder also includes passive EAS and/or RFID security elements. A wireless disable key can also be used to shut off an alarming transponder.

20 Claims, 19 Drawing Sheets

TO UTILITY POWER
38
28A 30A
20
24A
26A
27
22
24B
26B
35
32
30B
28B
38
TO UTILITY POWER

TO UTILITY POWER
38

30B
4
32
20
4
35
24B
24B
26B
22
27
24A
26A
30A
38
TO UTILITY POWER 28B
30B
38
45B
34
46B
46A
40
50B
50B
22A
32
22B
47
26B
44
B1
44
B2
47
B3
44
42
47
27
31
29

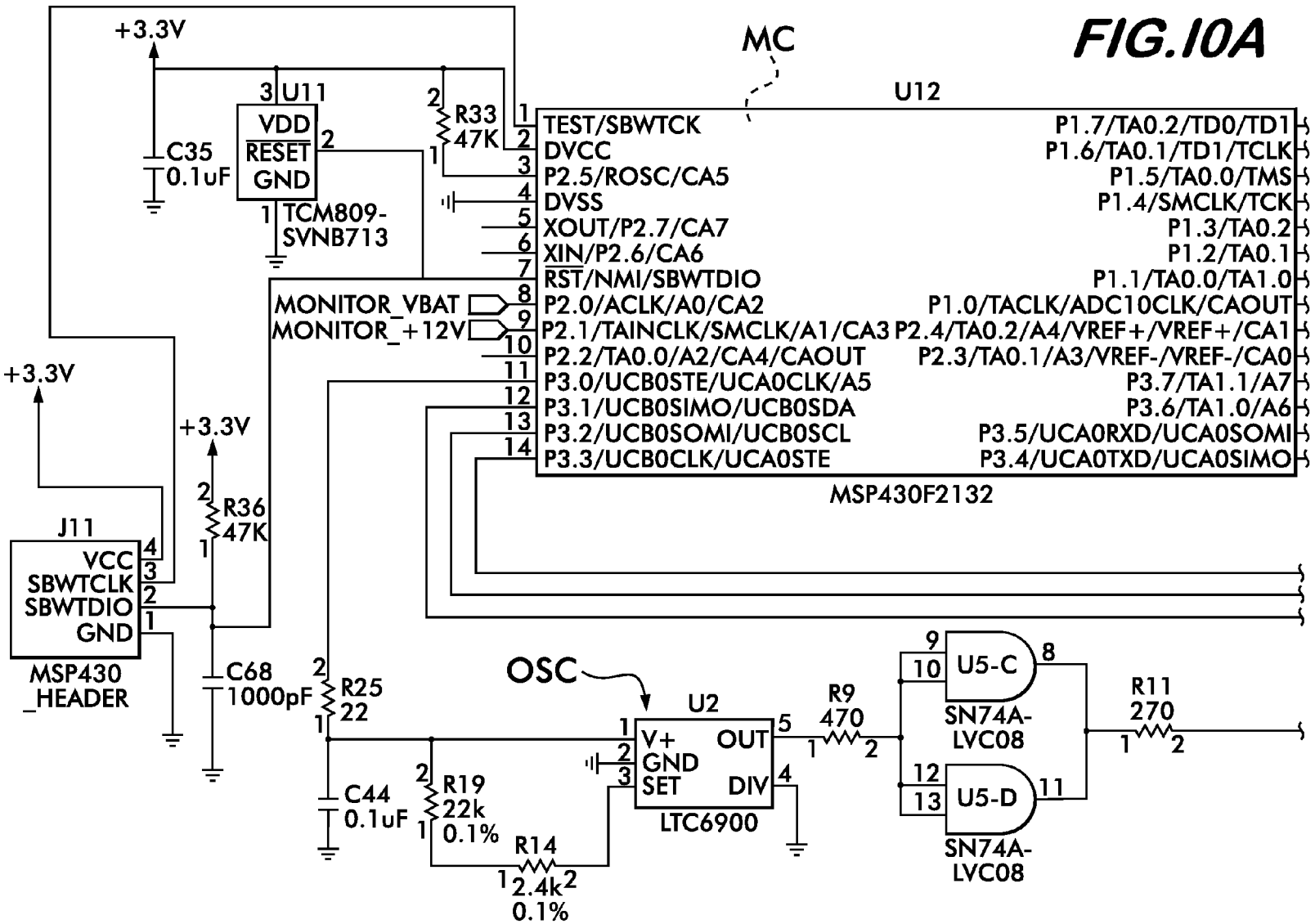
FIG. 10A
MC
U12
MSP430F2132
TEST/SBWTCK
DVCC
P2.5/ROSC/CA5
DVSS
XOUT/P2.7/CA7
XIN/P2.6/CA6
RST/NMI/SBWTDIO
P2.0/ACLK/A0/CA2
P2.1/TAINCLK/SMCLK/A1/CA3
P2.2/TA0.0/A2/CA4/CAOUT
P3.0/UCB0STE/UCA0CLK/A5
P3.1/UCB0SIMO/UCB0SDA
P3.2/UCB0SOMI/UCB0SCL
P3.3/UCB0CLK/UCA0STE
P1.7/TA0.2/TD0/TD1
P1.6/TA0.1/TD1/TCLK
P1.5/TA0.0/TMS
P1.4/SMCLK/TCK
P1.3/TA0.2
P1.2/TA0.1
P1.1/TA0.0/TA1.0
P1.0/TACLK/ADC10CLK/CAOUT
P2.4/TA0.2/A4/VREF+/VREF+/CA1
P2.3/TA0.1/A3/VREF-/VREF-/CA0
P3.7/TA1.1/A7
P3.6/TA1.0/A6
P3.5/UCA0RXD/UCA0SOMI
P3.4/UCA0TXD/UCA0SIMO
MONITOR_VBAT
MONITOR_+12V
R33 47K
U11
VDD
RESET
GND
TCM809-SVNB713
C35 0.1uF
+3.3V
R36 47K
C68 1000pF
J11
VCC
SBWTCLK
SBWTDIO
GND
MSP430 _HEADER
R25 22
C44 0.1uF
R19 22k 0.1%
R14 2.4k 0.1%
OSC
U2
V+
GND
SET
OUT
DIV
LTC6900
R9 470
U5-C
U5-D
SN74A-LVC08
R11 270

PA
T0
J2
(FIG.13A)
J16
P1-GND
P2-PIR VDD
P3-PIR IN
P4-SW OUT
P5-SW IN
P6-LED OUT
MOLEX_35363-06
L16
1.8kOhm
PZ1
T2
PCB279
Q1BC847B
3C
2E
B
R18
1k
C34
4.7uF
+3.3V
C11
100pF
R5
1k
R4
22
R3
3k
C2
100pF
R2
3k
R1
22
R21
3k
R12
1k
R13
22
C41
100pF
C1
100pF
C45
0.1uF
DRIVE_A
DRIVE_B
R24
1.5k
R20
1.5k
U5-A
U5-B
SN74A-LVC08
R22
470k
C42
100pF
R23
1k
R10
1k
C65
0.1uF
U8
U4
CLK
GND
D
CLR
VCC
Q
SN74LVC1G175
L5
L3
L1
L17
L14
1.8k Ohm
PWR_STATUS
BOOST_EN
FET_PWR
FET_EN
28
27
26
25
24
23
22
21
20
19
18
17
16
15

TRANSMIT-ONLY ELECTRONIC ARTICLE SURVEILLANCE SYSTEM AND METHOD

CROSS-REFERENCE TO RELATED APPLICATIONS

This utility application claims the benefit under 35 U.S.C. §119(e) of Provisional Application Ser. No. 61/174,734 filed on May 1, 2009 entitled TRANSMIT-ONLY EAS and whose entire disclosure is incorporated by reference herein.

BACKGROUND OF THE INVENTION

1. Field of Invention

The present invention generally relates to the field of merchandise security, and more particularly, to a system and method for alarming security tags using low profile and low power field projectors that can be easily installed at various locations in and around a business environment.

2. Description of Related Art

One way of providing security for merchandise in a retail facility is the use of traditional electronic article surveillance (EAS) systems. System systems include a transponder affixed to each article of merchandise to be protected and an EAS detection gate. See U.S. Pat. Nos. 4,692,747 (Wolf) and 4,831,363 (Wolf). The transponder normally takes the form of an electromagnetically responsive element enclosed in a plastic label, paper tag, sleeve of fabric, or hard plastic case. The responsive element may be a strip of ferromagnetic material, a section of acoustomagnetostrictive metallic glass, a parallel resonant circuit made with a capacitor and an inductor, or a strip antenna connected to a diode. These technologies, termed EM, AM, RF, and microwave, respectively, normally operate at a characteristic frequency determined by a combination of, regulatory, and historical reasons. The detection device consists of an antenna connected to both a transmitter and a receiver. The transmitter is arranged to provide a stimulating signal to the transponder element. The receiver is arranged to determine whether a transponder element of the requisite type is near the detector. Typically, detection devices are used to sound an alarm if a transponder is detected by a device located at a point of egress. When merchandise is purchased, EAS transponders may either be removed or deactivated by the application of special electromagnetic fields.

Traditional EAS provides several advantages. First, for EM, AM, and RF EAS, the detection device antenna is normally quite large and, as such, presents a visual deterrent to would-be malefactors. Next, when the detection devices are placed at points of egress, the retail facility operator can allow shoppers to freely handle and move merchandise within the store with the certainty of knowing that any attempt to remove merchandise from the facility prior to purchase will result in an alarm.

Traditional EAS however has several disadvantages. The detection systems are relatively expensive to buy. Worse, their installation can be costly since it often requires "trenching," i.e., cutting channels into concrete flooring, to facilitate power wiring. Further, EAS detection systems require careful installation and routine maintenance because the signals from the transponders are of very low amplitude: only a small portion of the transmitted power reaches the transponder, and only a small portion of the energy reflected by the transponder reaches the receiver. As a result, retail facilities limit where they install and maintain EAS detection gates.

Three-Alarm EAS Transponders

At one extreme, an EAS transponder may consist solely of an electromagnetically responsive element which is embedded in an article of merchandise. At the other extreme, the transponder may be a complex assembly encompassing not just the responsive element, but also tamper detection and alarm sounding mechanisms. In addition, the transponder may be equipped with sensing circuitry capable of detecting the transmission of the EAS detection gate, and sound an alarm accordingly. A transponder equipped with all these features provides three means for sounding an alarm indicative of mishandling of merchandise:

(a) an alarm sounded by the EAS detection gate when the responsive element is nearby;

(b) an alarm sounded by the transponder itself when tampering is detected; and (c) an alarm sounded by the transponder when the EAS detection gate is nearby.

See also U.S. Pat. Nos. 7,663,489 (Scott, et al.); 7,538,680 (Scott, et al.); and 7,474,215 (Scott, et al.), directed to three-alarm transponders and all of whose entire disclosures are incorporated by reference herein.

These transponders may be affixed to or embedded with articles of merchandise in a variety of ways. Like ordinary EAS transponders, they may be embedded inside the merchandise itself or within the packaging for merchandise. They may be affixed permanently to the merchandise as by a permanent adhesive, lanyard, rivet, etc. Preferably they are detachably affixed via a mechanism which remains locked prior to sale and is unlocked post-sale by either the customer or the sales associated. Common means include the use of spring-clutch arrangements susceptible to opening via magnetic means or electronic means.

These transponders have the advantage of sounding an alarm anywhere that an improper attempt to is made to remove the transponder from the article of merchandise, e.g., in a fitting room or restroom, even where there is no detection device. In addition, such transponders may detect an improper removal of protected merchandise from a retail facility by sensing the proximity of an EAS detection gate, even when the return signal from the transponder to the EAS detection gate is too attenuated to allow the EAS detection gate to alarm.

These transponders can also be arranged to alarm only when the received stimulus signal includes special characteristic, such as amplitude, frequency, phase, or code modulated identifier. Such modulations can be impressed upon a base EAS transmission signal.

The following references are just a few examples of security tag systems wherein an alarm is included within the security tags themselves.

U.S. Pat. No. 4,851,815 (Enkelmann), whose entire disclosure is incorporated by reference herein, discloses a system for monitoring merchandise in a retail environment that utilizes a security tag which includes an alarming mechanism therein. The alarm is activated if (1) a loop which attaches the security tag to the merchandise is severed or if a casing associating with the merchandise is opened; or (2) if an alarm code from a transmitter is received by the security tag. The system also includes a means for transmitting a "clear code" that deactivates the alarm when appropriate.

DE 198 22 670 (Rapp), whose entire disclosure is incorporated by reference herein, discloses three different configurations of a system for monitoring merchandise using security tags that includes alarms therein. In a first embodiment of the system, the security tag alarm remains silent as long as the security tag (and the merchandise associated therewith) receiver is receiving particular transmitted signals at regular intervals in a particular zone; departure beyond this zone results in loss of the transmitted signals and therefore the activation of the security tag alarm. In a second embodiment, entry into another zone results in the security tag receiver receiving a signal that causes the alarm to activate. A third embodiment combines the features of both the first and second embodiments.

GB 2 205 426 (Yamada), whose entire disclosure is incorporated by reference herein, discloses a container case for housing a commodity (e.g., CD-ROM, DVD, etc), wherein the container case includes a removal detector, alarm and transmitter. Should a would-be thief attempt to remove the commodity from the container case without purchasing the commodity, the alarm in the container case is activated and a signal is transmitted to a remotely-located receiver and alarm. In addition, if a would-be thief attempts to exit the retail establishment with the commodity inside the container case without purchasing the commodity, an exit gate activates the container case alarm and the container case also transmits a signal to the remotely-located receiver and alarm. Also, another embodiment replaces the container case with an element that includes a loop for coupling to the commodity and wherein the element electronics includes a detector for detecting and alarming when the loop is severed.

Benefit Denial

One alternative to traditional EAS is the use of so-called benefit denial devices. Typically, these devices are plastic housings that are detachably affixed to merchandise. They are removed at the time the merchandise is purchased. The housing may enclose a tamper detection device, such as a sounding alarm, or a tamper detriment element such as a vial of ink. Attempting to remove the benefit denial device will result in the alarm sounding or ink spilling on the culprit, the merchandise, or both.

Benefit denial devices do serve as a visual deterrent to theft. However, they suffer from the disadvantage of not being detectable at a distance electronically. Thieves are often able to remove merchandise to a restroom or a quite corner of a store and there apply special tools to remove the tag. Alternatively, they may remove merchandise from the store without sounding an alarm and remove the device later at their leisure.

In view of the foregoing, though, there still remains a need for implementing an EAS transponder system/method that utilizes a low power and a low profile EAS beacon that can be easily and quickly installed in almost any desired location in a business environment.

BRIEF SUMMARY OF THE INVENTION

An antitheft security system is disclosed wherein the system comprises: an electromagnetic (EM) field generator, wherein the EM field generator comprises a housing to which at least one antenna is coupled thereto, wherein the at least one antenna generates the EM field of a predetermined frequency, and wherein the housing is securable to a surface or surfaces in a plurality of orientations. The system further comprises at least one security tag comprising a circuit tuned to the predetermined frequency, a detector and an alarm, wherein the detector detects the EM field received by the circuit and either activates the alarm or maintains the alarm in a deactivated condition depending upon a security zone configuration of the antitheft security system.

A method for establishing an antitheft security system is disclosed wherein the method comprises: generating an electromagnetic (EM) field of a predetermined frequency by energizing at least one antenna that is coupled to a power source and wherein the at least one antenna is coupled to a housing that is securable to a surface or surfaces in a plurality of orientations; coupling a security tag to an item of merchandise, wherein the security tag comprises a circuit tuned to the predetermined frequency and a detector; permitting the security tag to encounter the EM field; and detecting, by the detector, the EM field encountered by the circuit of the security tag.

An antitheft security system is disclosed wherein the system comprises: a first electromagnetic (EM) field generator, wherein the first EM field generator comprises a housing to which at least one antenna is coupled thereto, wherein the at least one antenna generates the EM field of a first predetermined frequency, and wherein the housing is securable to a surface or surfaces in a plurality of orientations for extending a security zone of an existing security system; a pair of electronic article surveillance (EAS) pedestals of the existing security zone that generate a second EM field at a second predetermined frequency and receive a reflected response signal of the second EM field, and wherein the EAS pedestals comprises a an alarm; at least one security tag comprising a circuit tuned to the first predetermined frequency, a detector, an EAS element tuned to the second predetermined frequency; and wherein the alarm of the EAS pedestals activates when the EAS pedestals detect said second reflected response signal.

A method for establishing an antitheft security system is disclosed and wherein the method comprises: generating a first electromagnetic (EM) field of a first predetermined frequency by energizing at least one antenna that is coupled to a power source and wherein the at least one antenna is coupled to a housing and wherein the housing is securable to a surface or surfaces in a plurality of orientations; generating a second EM field of a second predetermined frequency of the existing antitheft security system by energizing a pair of electronic article surveillance (EAS) pedestals of the EAS pedestals comprising an alarm; coupling a security tag to an item of merchandise, wherein the security tag comprises a circuit tuned to the first predetermined frequency, a detector, an EAS element tuned to a second predetermined frequency; and detecting, by the detector, the first EM field encountered by the circuit; and activating the alarm of the EAS pedestals when the EAS pedestals detect the second reflected response signal.

An antitheft security system for extending a security zone of an existing EAS antitheft system is disclosed. The system comprises: a first electromagnetic (EM) field generator, wherein the first EM field generator comprises a housing to which at least one antenna is coupled thereto, wherein the at least one antenna generates the EM field of a first predetermined frequency, wherein the housing is securable to a surface or surfaces in a plurality of orientations for extending a security zone of an existing security system; a second EM field generator of the existing EAS antitheft system that generates a second EM field at the first predetermined frequency and receives a reflected response signal of the second EM field, the second EM field generator comprising an alarm; wherein the first EM generator generates the first EM field such that it emulates a field pattern of the second EM field generator; at least one security tag comprising a circuit tuned to the first predetermined frequency, a detector, and an EAS element tuned to the first predetermined frequency; and wherein the alarm of the second EM field generator activates when the second EM field generator detects a reflected response signal from the EAS element A method for extending a security zone of existing antitheft security system is disclosed. The method comprises: generating a first electromagnetic (EM) field of a first predetermined frequency by energizing at least one antenna that is coupled to a power source and wherein the at least one antenna is coupled to a housing and wherein the housing is securable to a surface or surfaces in a plurality of orientations; generating a second EM field of the first predetermined frequency of the existing antitheft security system by energizing a pair of electronic article surveillance (EAS) pedestals, wherein the EAS pedestals comprise an alarm, and wherein the first EM field is generated such that it emulates a field pattern of the second EM field; coupling a security tag to an item of merchandise, wherein the security tag comprises a circuit tuned to the first predetermined frequency, a detector, and an EAS element tuned to the first predetermined frequency; detecting, by the detector, wherein the first EM field encountered by the circuit; and activating the alarm of the EAS pedestals when the EAS pedestals detect a reflected response signal from the EAS element.

BRIEF DESCRIPTION OF SEVERAL VIEWS OF THE DRAWINGS

The invention will be described in conjunction with the following drawings in which like reference numerals designate like elements and wherein:

FIG. 10A-10B together comprise the EAS beacon microcontroller and coil command circuitry;

DETAILED DESCRIPTION OF THE INVENTION

Figure 1:
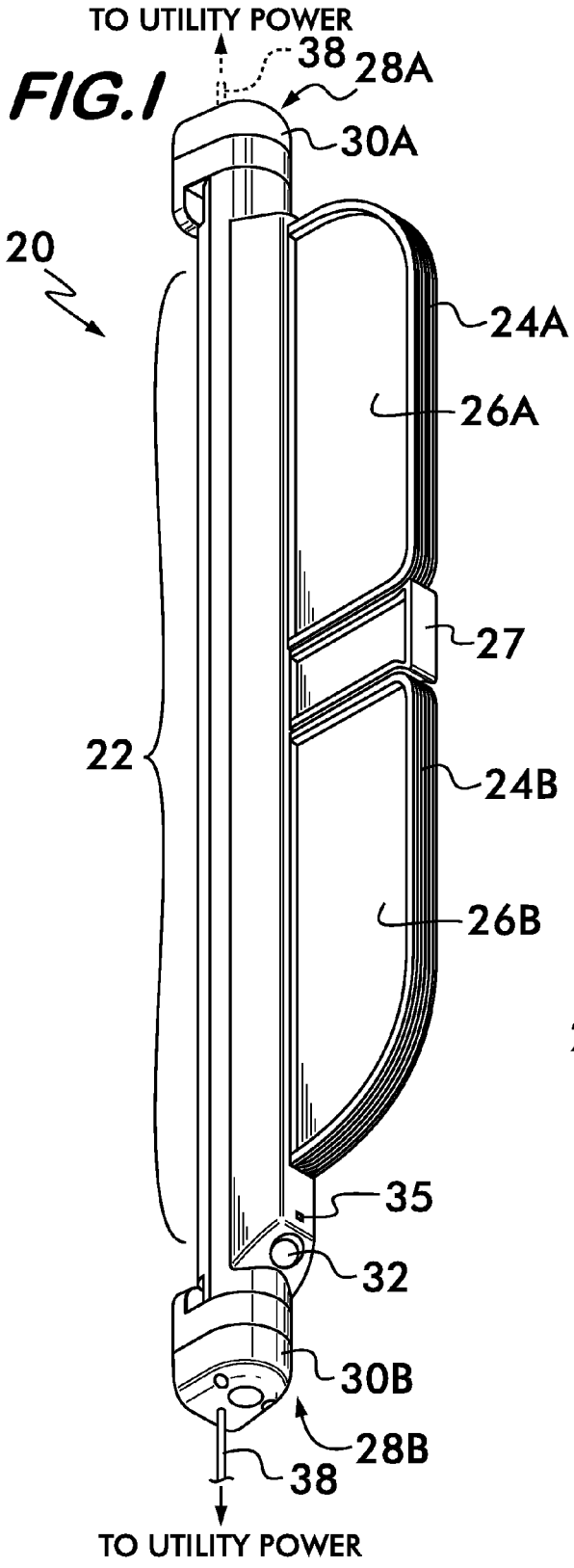
FIG. 1 is an isometric view of the EAS detection gate or "beacon" and depicts how it is positioned when it is installed in a vertical orientation.

As will be discussed in detail later, the preferred embodiment of the present invention is the inclusion of an EAS beacon 20 (FIG. 1) and its associated security tag transponder 10 (FIG. 7) into a complete EAS system (420, FIG. 16) in which traditional, advanced, and new features are combined to provide broader coverage against improper handling of merchandise in a fashion which is dramatically more economical. The complete EAS system 420 includes an EAS detection gate (422) including a transmission means for transmitting an EAS interrogation signal and an annunciation means (416) for expressing an alarm condition for human or machine recognition. The EAS detection gate (422) may operate at any of the standard EAS frequencies, including those for EM, AM, RF, UHF, microwave, or equivalent spectra. Herein the term "RF" is used loosely to refer to any of the EAS electromagnetic radiation spectra.

In addition, the system includes a passive EAS transponder (10C) including a transponding means for reflecting a portion of the EAS interrogation signal. Also included is a transmit-only RF EAS beacon 20 (hereinafter "EAS beacon 20") including an RF transmission means for transmitting an EAS alert beacon signal (hereinafter referred to as an "electromagnetic (EM) field"). Notably the operating frequency of the EAS alert beacon 20 and the operative frequency of the passive EAS transponder 10C could be the same frequency or unrelated. Any combination is possible, provided that various interoperating devices of the system use the same frequency range for each peculiar function of the system 420. As will be discussed in detail next, unlike an EAS detection gate 422, the EAS beacon has no requirement for receiving reflected energy from a passive EAS transponder 10. Thus the EAS beacon 20 does not need any detection circuitry, which provides dramatic cost savings, reduced complexity and size and power savings, along with ease of installation and maintenance. Equally significant, the EAS beacon 20 does not need a large antenna to couple to a nearby tag. In fact, it is possible to construct miniature beacons 20 no larger than a human hand that may be installed and/or concealed nearly anywhere. By comparison, the antennae of EAS detection gates 422 are typically four to six feet high and one to two feet wide.

The following discussion is thus directed to the EAS beacon 20, its parts and operation.

Figure 3:
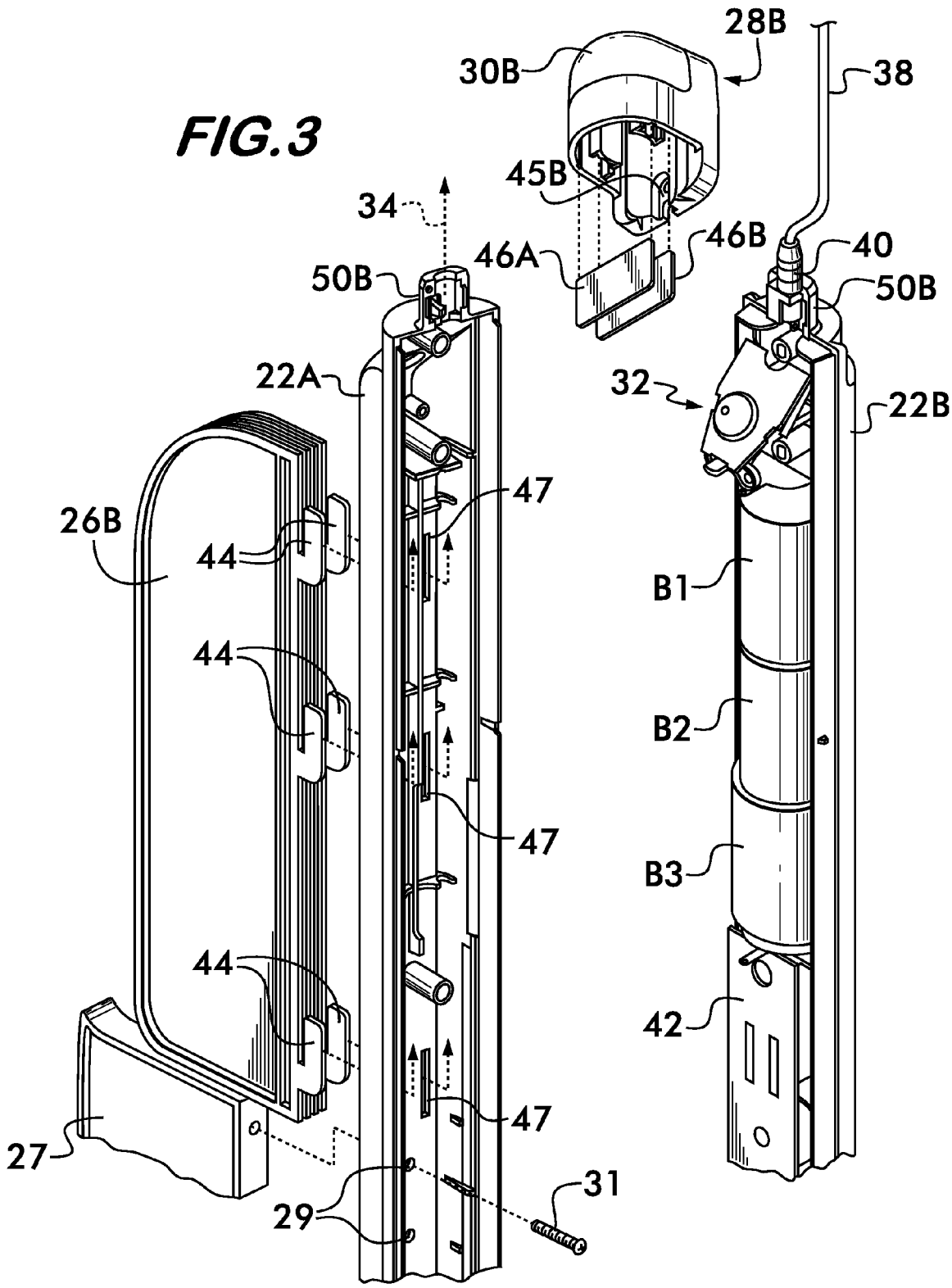
FIG. 3 is a partial exploded view of the EAS beacon and showing the passive infrared detector (PIR) and some of the internal batteries.
Figure 3A:
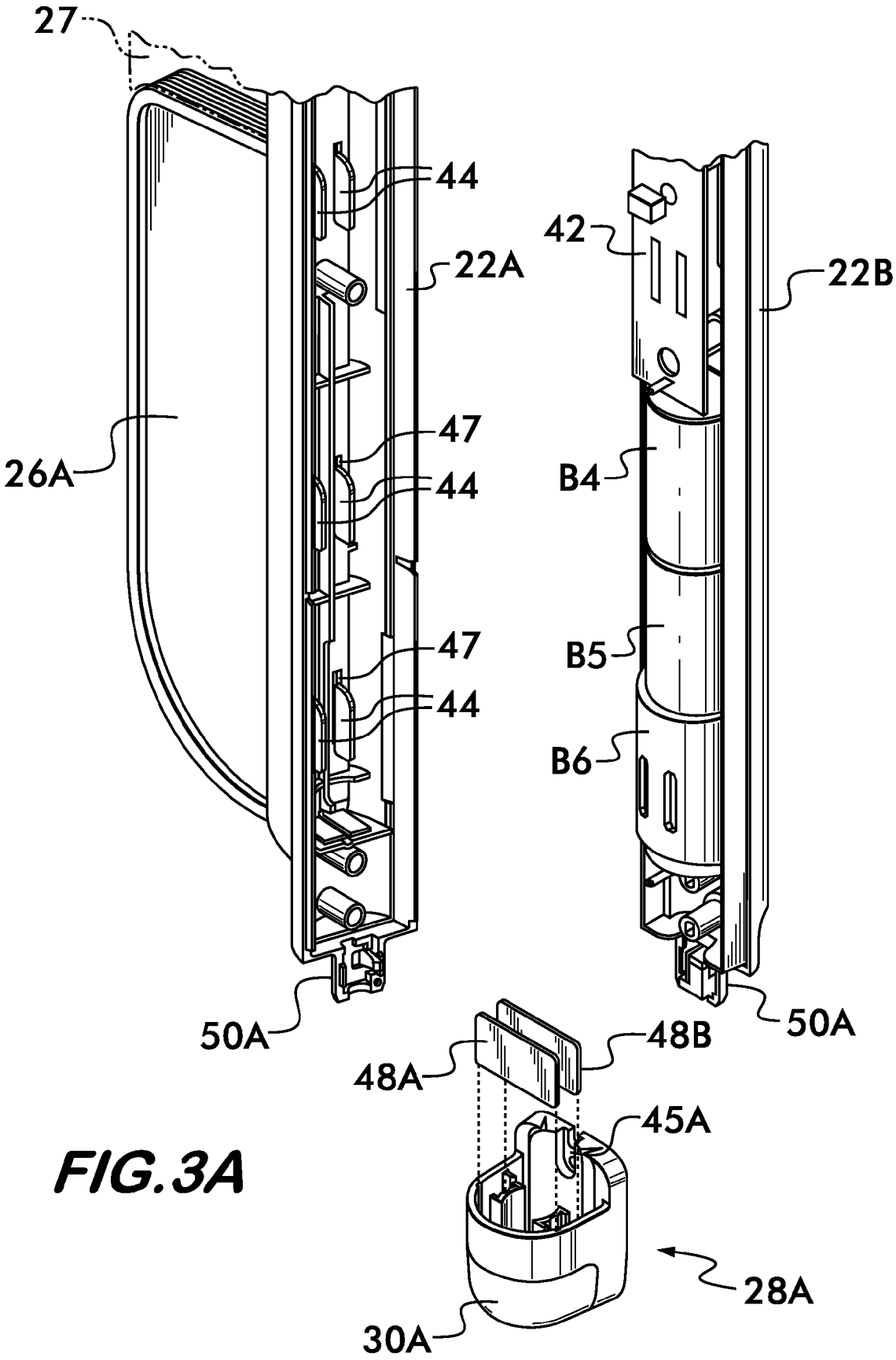
FIG. 3A is a partial exploded view of the EAS beacon showing the other end of the EAS detection gate or beacon.
Figure 5:
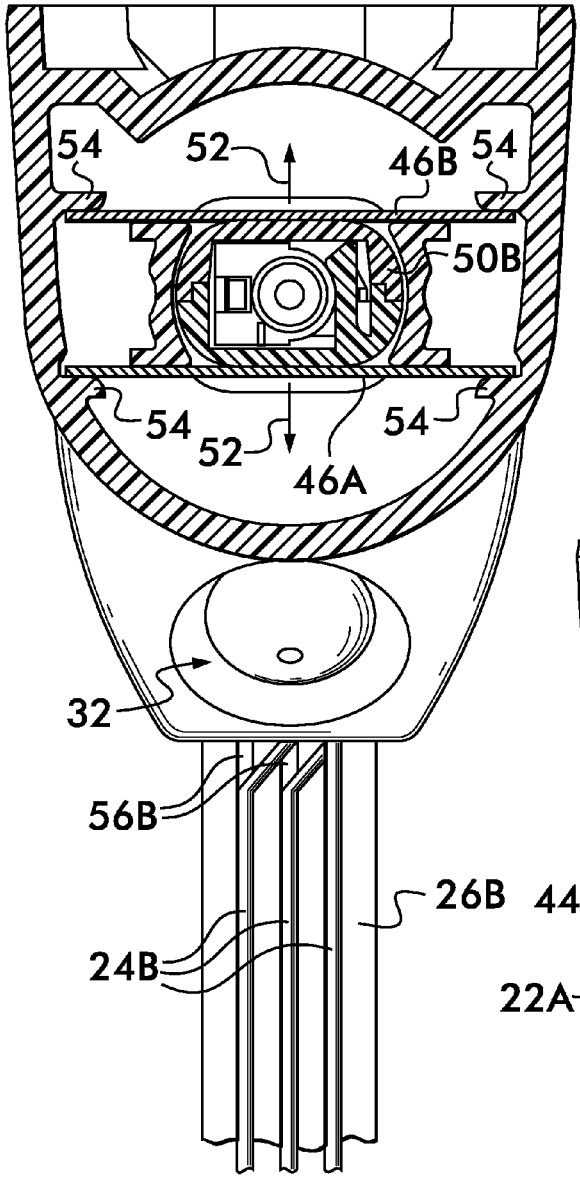
FIG. 5 is a cross-sectional view of the EAS beacon taken along line 5-5 of FIG. 4 showing the rounded rectangular contour of one end of the pivoting mechanism of the elongated member.
Figure 6:
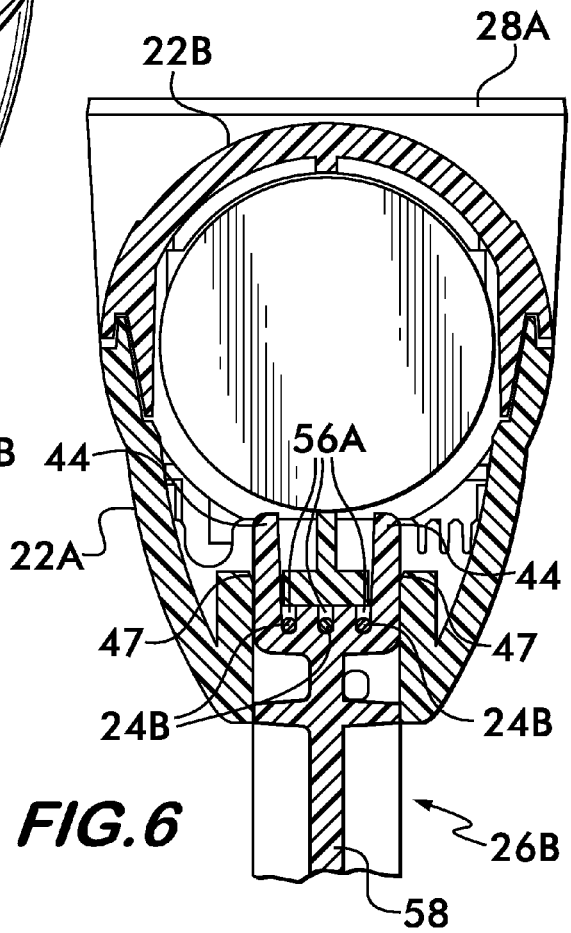
FIG. 6 is a cross-sectional view of the EAS beacon taken along line 6-6 of FIG. 4.

FIG. 1 is an isometric view of the EAS beacon 20. The EAS beacon 20 comprises an elongated member 22 which comprises the electronics and internal batteries (FIGS. 3-3A). A pair of coil windings 24A and 24B is provided by the EAS beacon 20 and each is housed within a respective panel 26A and 26B (e.g., polycarbonate (such as Lexan®) or acrylic (such as Plexiglass®), etc.) which are fixedly secured to the elongated member 22, as will also be discussed in detail later. However, the elongated member 22 itself is pivotally mounted within end brackets 28A and 28B that permit the elongated body 22 to rotate about an axis 34 shown in FIG. 5, to avoid damaging the panel members 26A/26B in a situation where something comes into contact with the panel members 26A/26B. At the extreme ends of the elongated members are end caps 30A/30B which cover access to DC power couplings 36A/36B to the EAS beacon 20. The dual provision of power couplings allows the EAS beacon 20 to be mounted in various orientations and to permit the most convenient coupling to utility power sources in the vicinity. A power cord 38 and AC/DC converter (not shown) is provided that couples to the utility power (e.g., a wall outlet) while the other end of the power cord comprises a DC connector 40, one of which is shown in FIG. 6. By removing the appropriate end cap, 30A or 30B, which exposes the respective DC power coupling 36A or 36B, the DC connector 40 can be connected and then the end cap re-installed. A passive infrared detector (PIR) 32 is provided to detect motion in the vicinity of the EAS beacon 20 when battery power is being used by the EAS beacon 20 and therefore is able to conserve EAS beacon power when no motion is detected in the vicinity. A middle element or spacer 27 is provided between the two panel members 26A/26B. This spacer 27 provides separation between the coils 24A/24B, thereby reducing coil coupling in the near field.

It should be understood that although two coils 24A and 24B are shown in the preferred embodiment of the EAS beacon 20, it is within the broadest scope of the present invention 20 to operate using a single coil. The term "coil" as used throughout this Specification may also be referred to as "antenna".

As shown in FIGS. 3-3A, the elongated member 22 comprises half shells 22A and 22B. Half shell 22B houses the PIR 32, batteries B1-B6 (e.g., D-type cells), a circuit board 42 that comprises the EAS beacon electronics, the details of which will be discussed later. Half shell 22A comprises the attachment for the coil winding panel members 26A/26B. The half-shells 22A/22B are secured together with tamper-proof screws (one of which 31 is shown) that are inserted in holes throughout the shells 22A/22B, two of which 29 are shown in FIG. 3. Although not shown, two battery compartment doors are provided in shell 22B for removing/inserting the batteries. As can also be seen in FIGS. 3-3A, the panel member 26A/26B have projections 44 that pass through and lock in corresponding slots 47 (see FIG. 3). As can be most clearly seen in FIG. 6, half-shell 22B is round in contour to permit it to easily pivot against the surface to which the EAS beacon 20 is mounted.

One of the important features of the present invention 20 is the ability of the EAS beacon 20 to displace or flex (e.g., using flex hinges) when contacted. One exemplary configuration of such a flex feature is via a pivoting mechanism. The pivoting mechanism of the elongated member 22 is achieved by utilizing a pair of flat springs in each of the end brackets 28A/28B in combination with a rounded rectangular tip at each end of the elongated member that is trapped between the flat springs. In particular, as shown in FIGS. 3-3A, a first pair of flat springs 46A/46B are installed in one end bracket 28B and a second pair of flat springs 48A/48B are installed in the other end bracket 28A. As shown most clearly in FIG. 5, each end of the elongated member 22 comprises a tip having an outer contour that resembles a rounded rectangle; in particular, tip 50B is shown in FIG. 5 with the long sides of the rectangle in contact with the respective flat springs 46A/46B. This is the normal position of the elongated member 22, resulting in the panel members 26A/26B being perpendicular to the elongated housing axis 34, as shown in FIG. 1. However, if a force is applied against either or both panel member 26A/26B (e.g., a large pallet or object, a person attempting to pass by the EAS beacon 20, etc.), the elongated member 22 is rotated, causing the flat springs 46A/46B to flex outward (see arrows 52). Once the force is no longer in contact with the panel members 26A/26B, the flat spring bias causes the springs 46A/46B to flex inward, thereby rotating the tips 50A (see FIGS. 3-3A) and 50B and restoring the panel members 26A/26B back to their perpendicular orientations. As shown in FIGS. 3-3A, the flat springs 46A/46B and 48A/48B are mounted in the bracket end pieces 28A/28B. The flat springs 46A/46B and 48A/48B are secured within the bracket end pieces using 28A/28B "heat staking" whereby the plastic spring supports 54 are heated such that a portion of the plastic is deformed and melted to the flat spring. Although the use of hinges for reducing damage to projecting antenna elements is known (e.g., U.S. Pat. No. 7,168,668 (Coyle)), the pivoting mechanism for the present invention is not as complex and is not as exposed as the one disclosed in the '668 patent.

As can also be seen in FIGS. 5-6, each of the panel members 26A and 26B comprises coil raceways 56A/56B respectively in which the coils 24A and 24B are wound. FIG. 5 shows the crossover of the coils 24B permitting a single conductor to form the coils 24B; although not shown the panel member 24A comprises a similar configuration. FIG. 6 also shows a partial cross-section of the one of the panel members 24A wherein the panel includes an inner support member 58 that is integral with the projections 44 that are shown positioned within the slots 47, as discussed earlier.

One of the key features of the EAS beacon 20 is the relative ease in which it can be installed. Since the EAS beacon 20 is self-contained, i.e., there is no other counterpart (e.g., conventional EAS detection pedestals that are coupled together through wires running under the floor) to which the beacon 20 needs to be connected, other than a power connection, the EAS beacon 20 can be installed easily by store staff or maintenance personnel. In particular, each end bracket 28A and 28B comprises a mounting bracket 45A and 45B, respectively (see FIGS. 3 and 3A), through which an attachment screw or bolt (not shown) is passed and secured to a surface (e.g., wall, lintel, post, etc.). The elongated member 22 can then be inserted such that the tips 50A/50B are captured between the flat spring pairs 46A/46B and 48A/48B to permit the pivoting of the elongated member 22. When the EAS beacon 20 is installed in a vertical position, the beacon 20 is installed in the orientation shown in FIG. 1. In this orientation, the PIR 32 is facing downward to detect motion in its vicinity. When the EAS beacon 20 is operating on battery power, rather than utility power, in order to conserve power, the EAS beacon 20 is designed to revert to a "sleep" or low power state when the PIR 32 is no longer detecting any motion in its vicinity. As soon as the PIR 32 detects motion, the beacon electronics are fully energized to operate normally.

Figure 4:
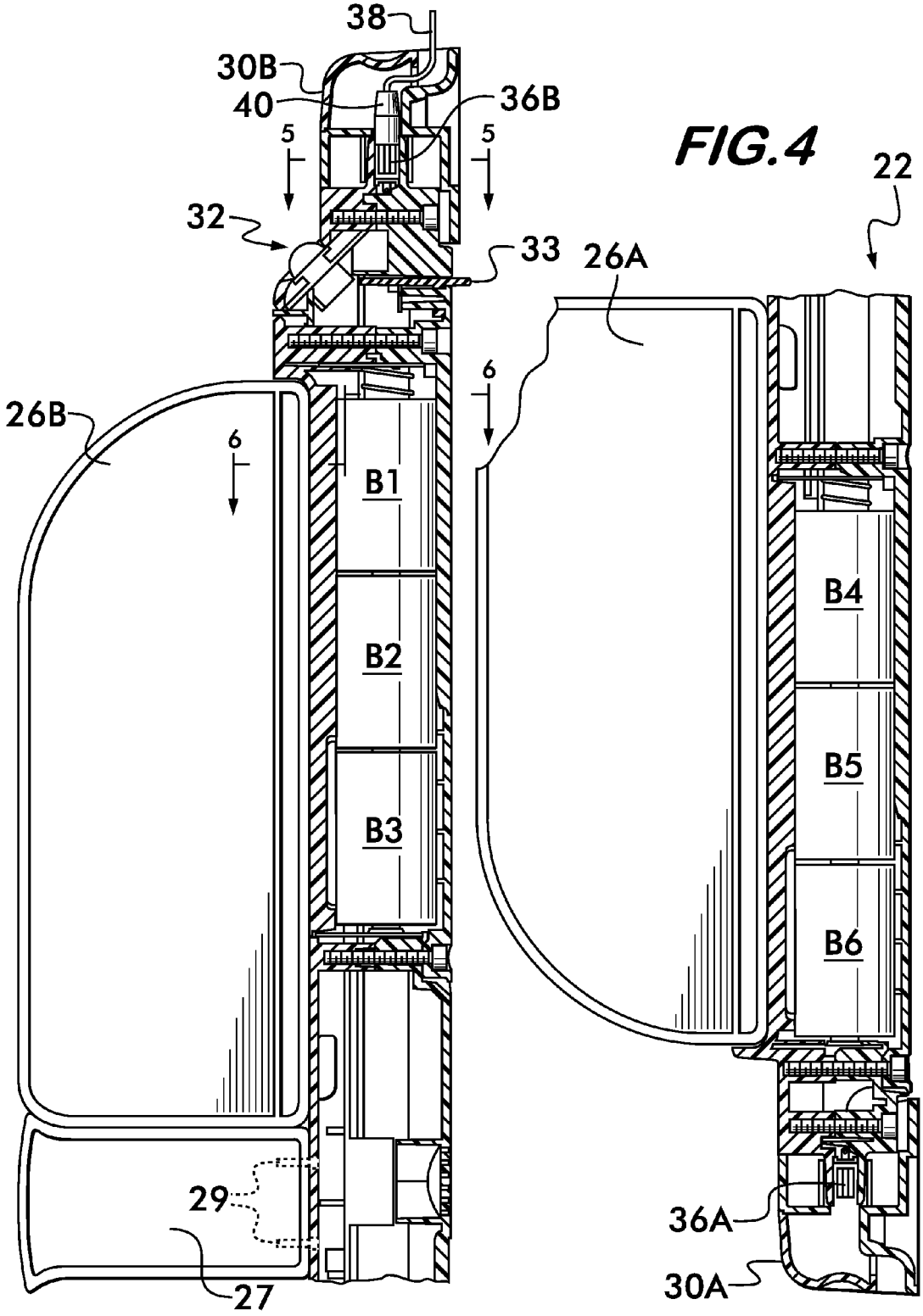
FIG. 4 is a cross-sectional view of the EAS beacon shown halved and taken along line of FIG. 4-4 of FIG. 2.
Figure 14:
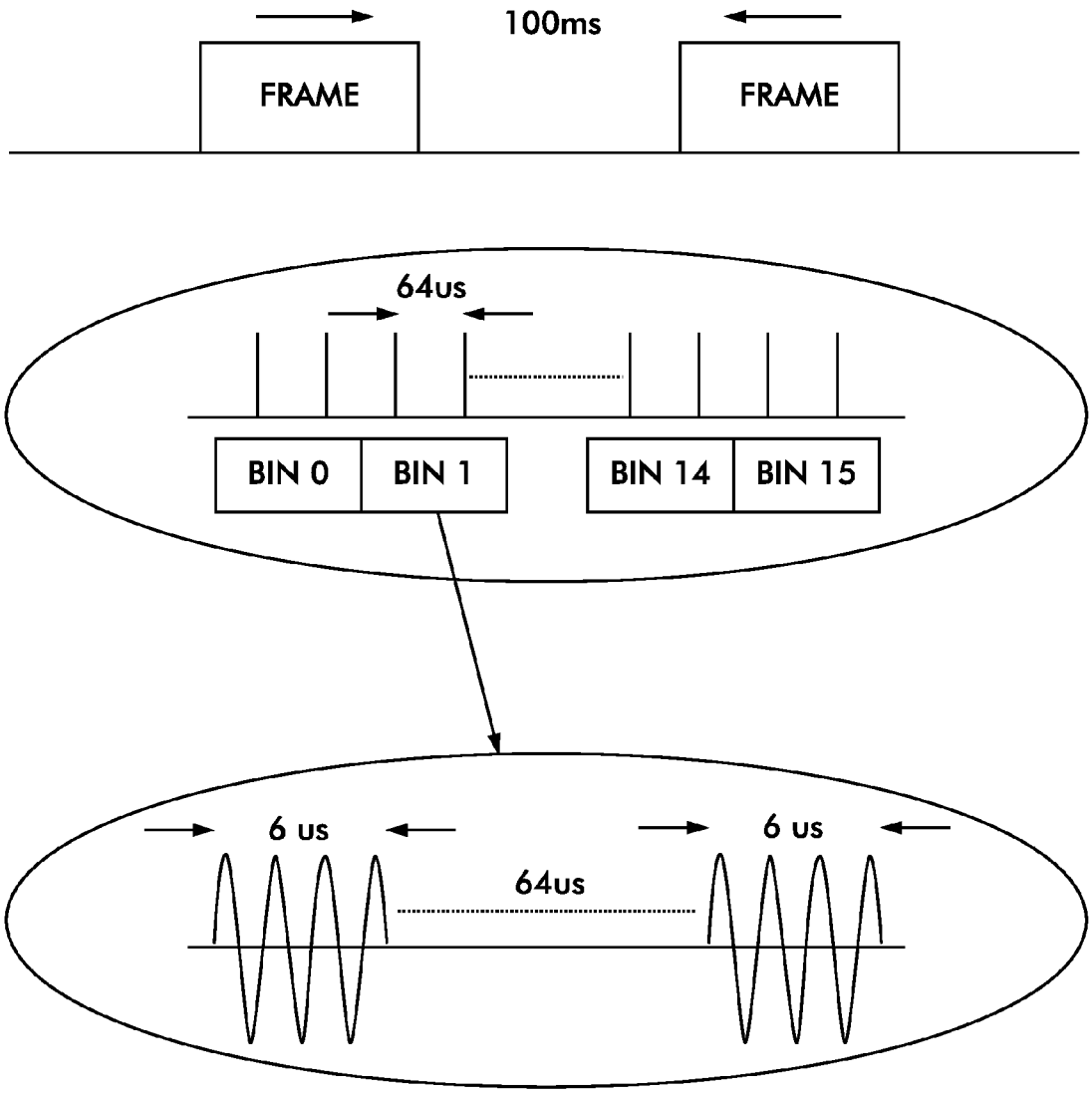
FIG. 14 is a pulse diagram of the EAS beacon which defines the "gate signature"

If the EAS beacon 20 is flexed or pivoted, as explained previously, or if attempts were to be made to dislodge the EAS beacon 20 from its mounted position or otherwise tamper with it, the beacon 20 includes a flex/pivot detection switch 33 (FIGS. 4 and 14A) which is biased outward but is driven inward of the housing 22 when the beacon 20 is mounted against a surface. As long as the EAS beacon 20 is pivoted or dislodged from its mounting, the switch 33 is driven outward by the bias (as shown in FIG. 4) which informs the beacon electronics to activate an alarm, e.g., an audible alarm such as a piezo alarm PA (FIG. 10B); alternatively or in conjunction with the audible alarm, a visual alarm could also be provided. Thus, any pivoting or tampering with the installed EAS beacon 20 causing it to be displaced just sufficiently away from the installation surface will cause the switch 33 to activate the alarm PA.

The electronics further comprise a detect switch timer which delays initiation of the alarm to avoid nuisance trips but also times out after a time period to avoid excessive battery consumption and to avoid annoying store personnel. The timing delay and time out periods can be configured for any desired time segments via the electronics' programming.

Figure 11A:
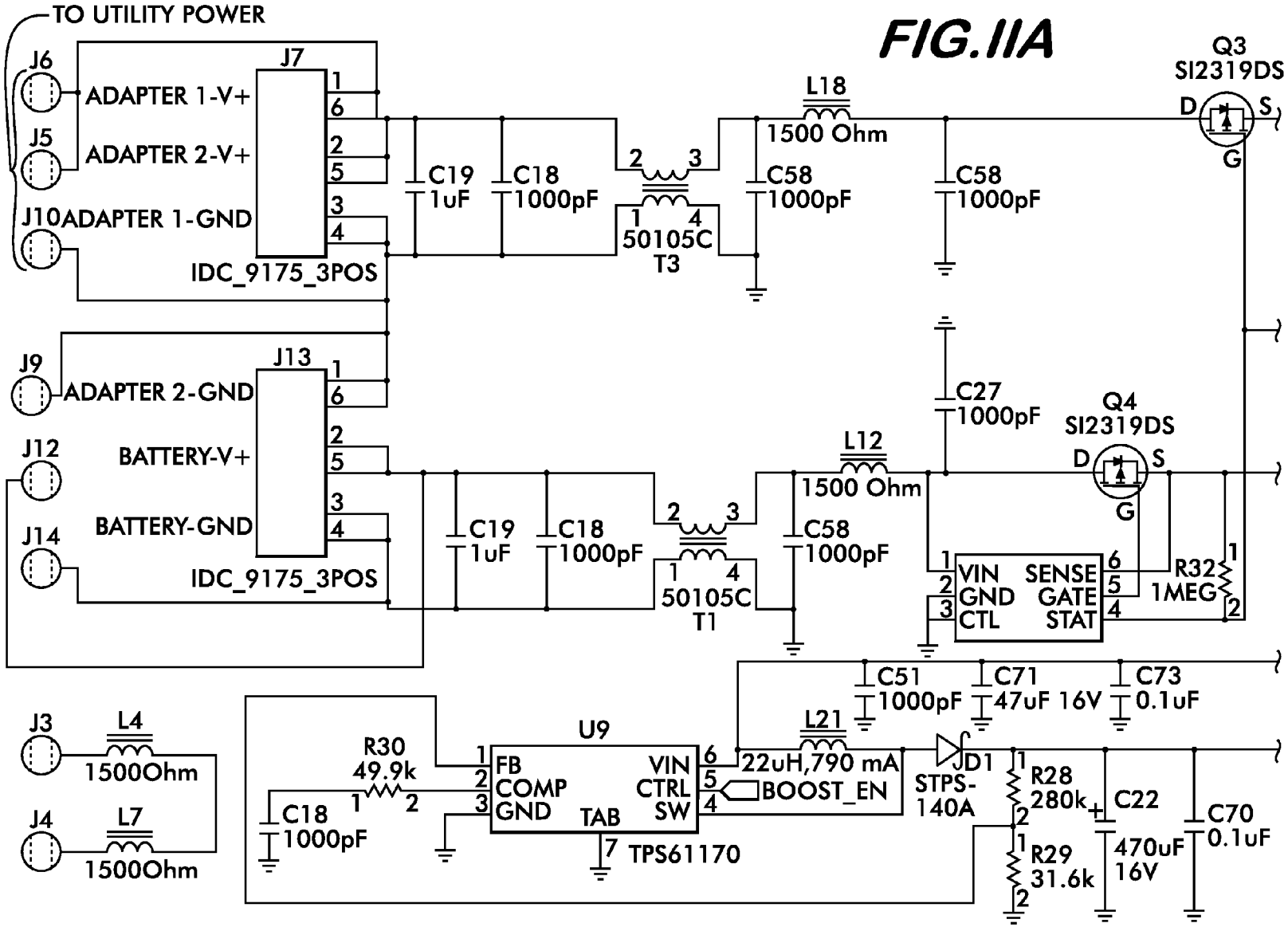
FIGS. 11A-11B together comprise the EAS beacon switching power supply.
Figure 11B:
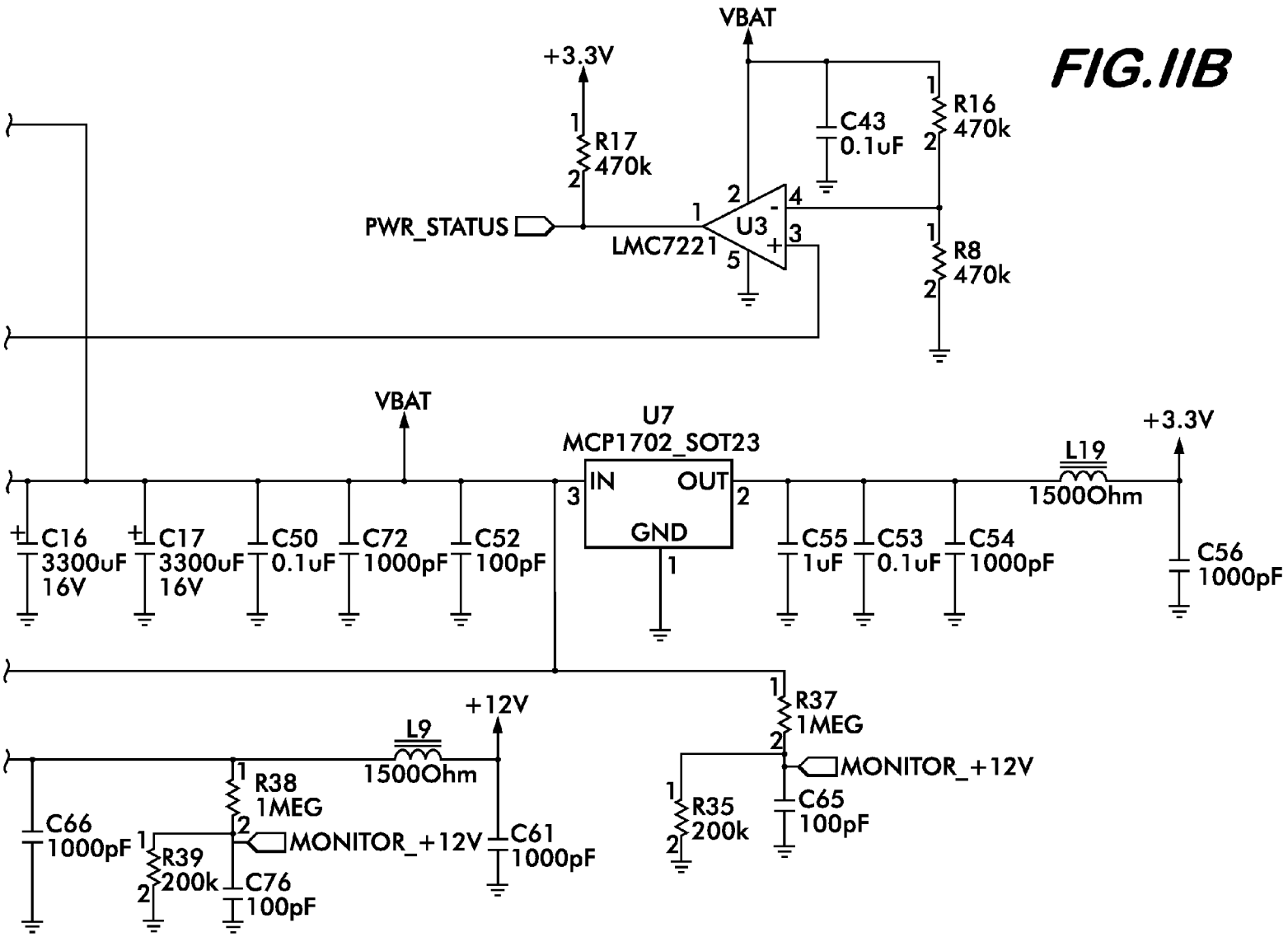

The EAS beacon electronics are housed on the circuit card 42 (FIG. 3A). It should be understood that in a preferred embodiment of the present invention 20, utility power is provided to the EAS beacon 20 but other types of power supplies can be the source of the EAS beacon 20 power. Furthermore, the term "utility power" as used throughout this Specification encompasses any "externally-provided" power to the EAS beacon 20. As shown in FIGS. 11A-11B, DC power can be provided to the switching power supply from the DC coupling 36A or 36B, whichever is connected to utility power. The switching power supply provides the 12 VDC and 3.3 VDC operating voltages for the electronics using low power. Should beacon power revert to battery power (e.g., loss of utility power, whether inadvertent or intentional), there is no loss of EAS beacon operation; conversely, should utility power be restored, the EAS beacon 20 reverts from battery power back to utility power again with no loss of operation. This no loss of operation during power source switching is an important feature of EAS beacon operation.

Should beacon power revert to battery power, in a preferred embodiment, the EAS beacon electronics may include the use of the PIR 32 to conserve as much battery power as possible. As mentioned earlier, with the EAS beacon 20 operating on battery power, the PIR 32 alerts a microcontroller MC (FIG. 10A) via PIR circuitry (FIGS. 13A-13B) to any motion in the vicinity: if motion is being detected, the microcontroller MC maintains the EAS beacon 20 in full power operation; if, on the other hand, no motion is being detected, the microcontroller MC causes the beacon electronics to revert to a low power or "sleep" mode until any motion is detected by the PIR 32. When utility power is powering the EAS beacon 20, the PIR 32 is deactivated since it is only used during battery operation.

Figure 10B:
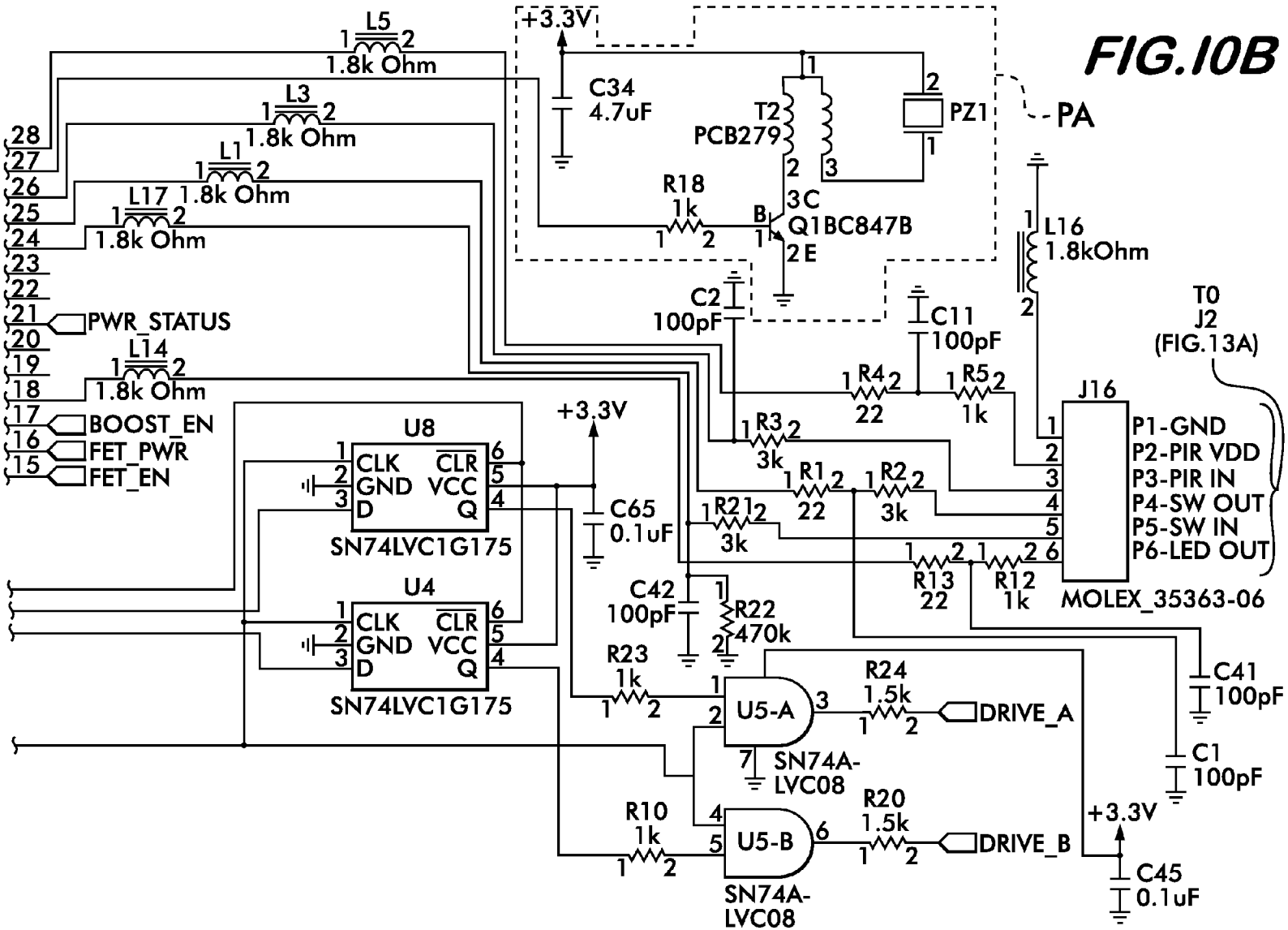
Figure 12A:
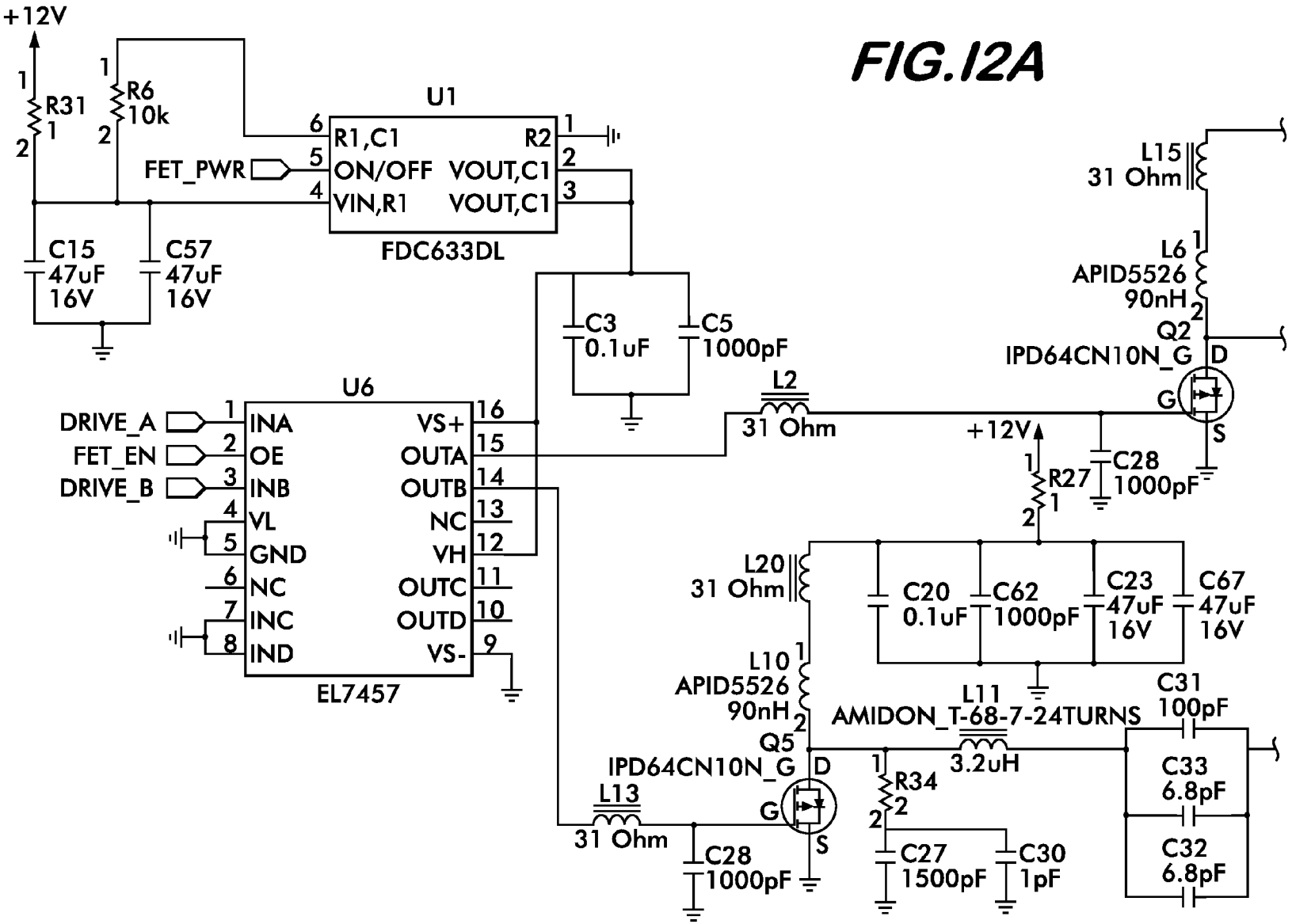
FIGS. 12A-12B together comprise the EAS beacon coil driver circuitry.
Figure 12B:
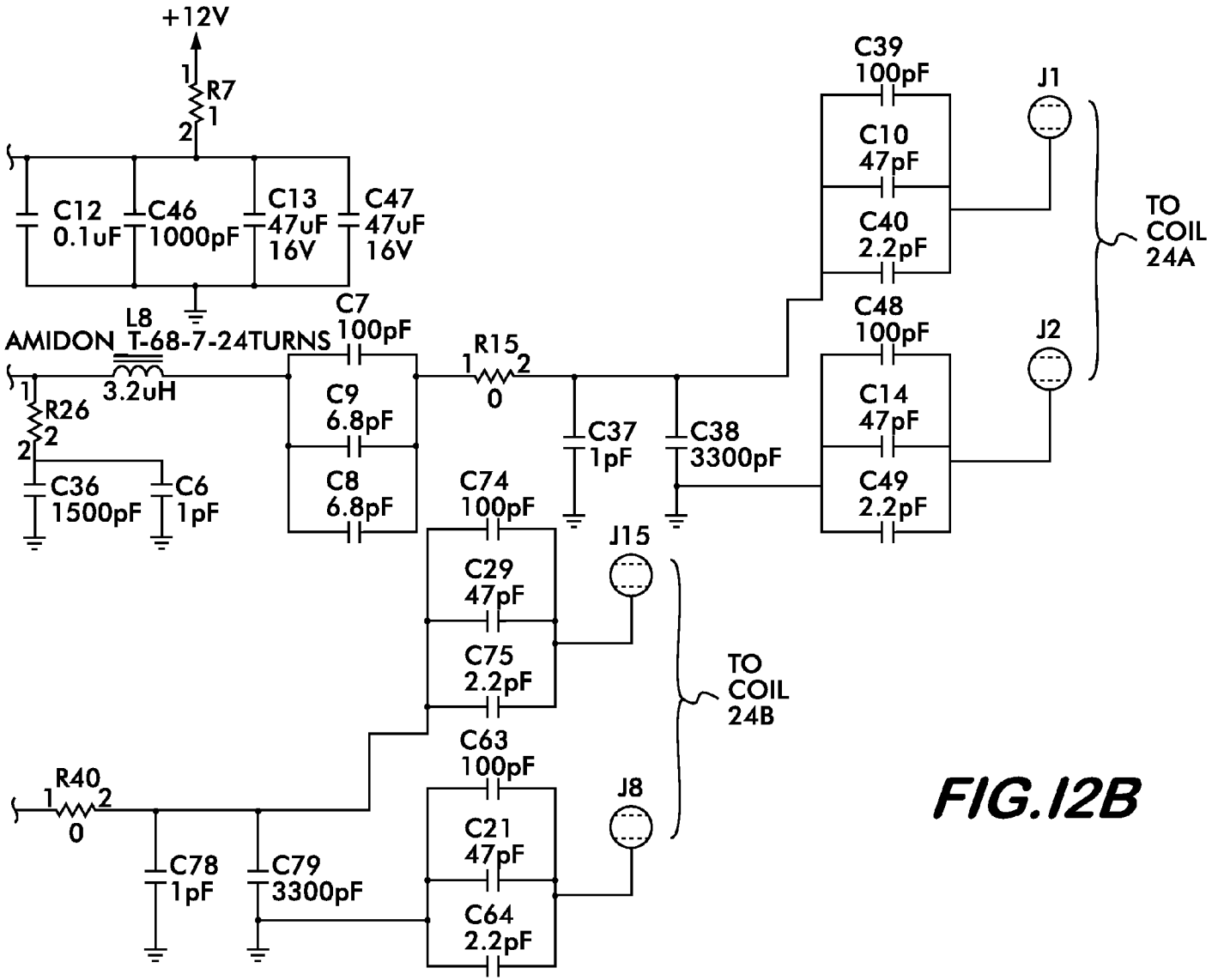

FIGS. 10A-10B depict the microcontroller MC and coil command circuitry with one path directed to coil 24A (DRIVE A) and one path directed to coil 24B (DRIVE B) for driving these coils 180° out of phase with respect to each other. FIGS. 12A-12B depict the actual driver circuits that take the drive commands and power their respective coils 24A/24B accordingly. Driving these coils 180° out of phase maximizes EM field detection by the security tag transponder 10 in the near field while eliminating or minimizing the EM field in the far field to comply with FCC regulations. The microcontroller MC monitors the 12 VDC as well as the battery power.

Figure 2:
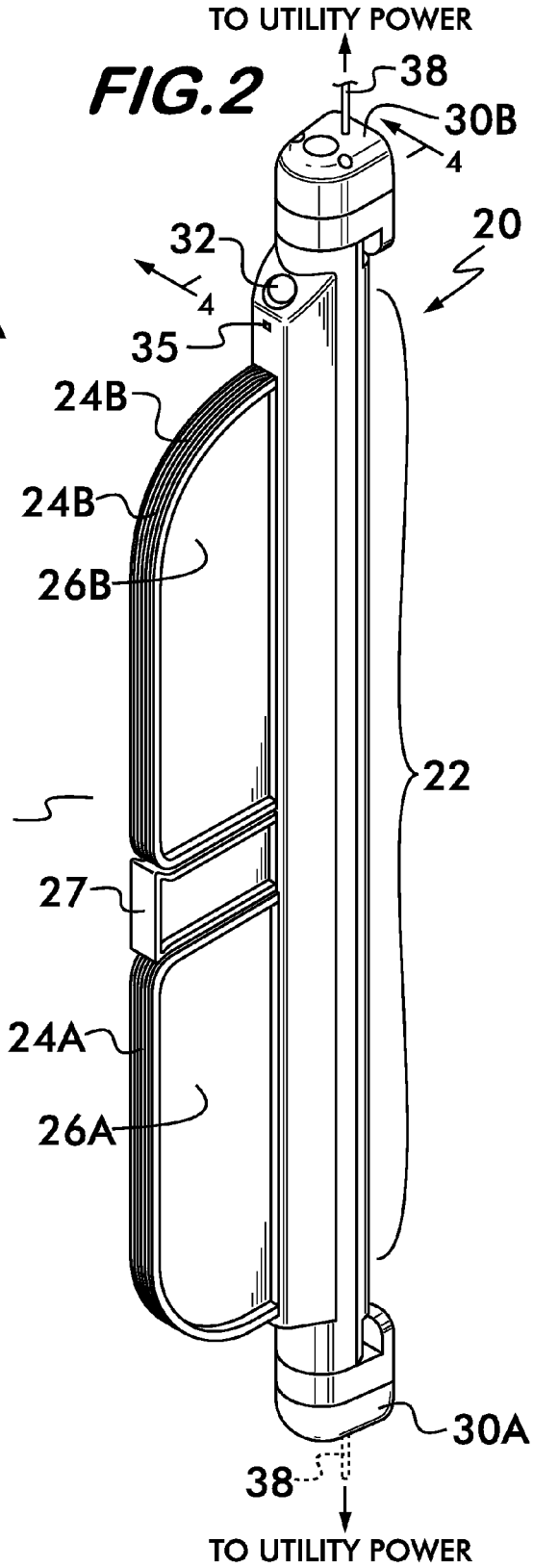
FIG. 2 is an isometric view of the EAS beacon shown in an inverted orientation and from which several of the views of subsequent figures are taken.
Figure 13A:
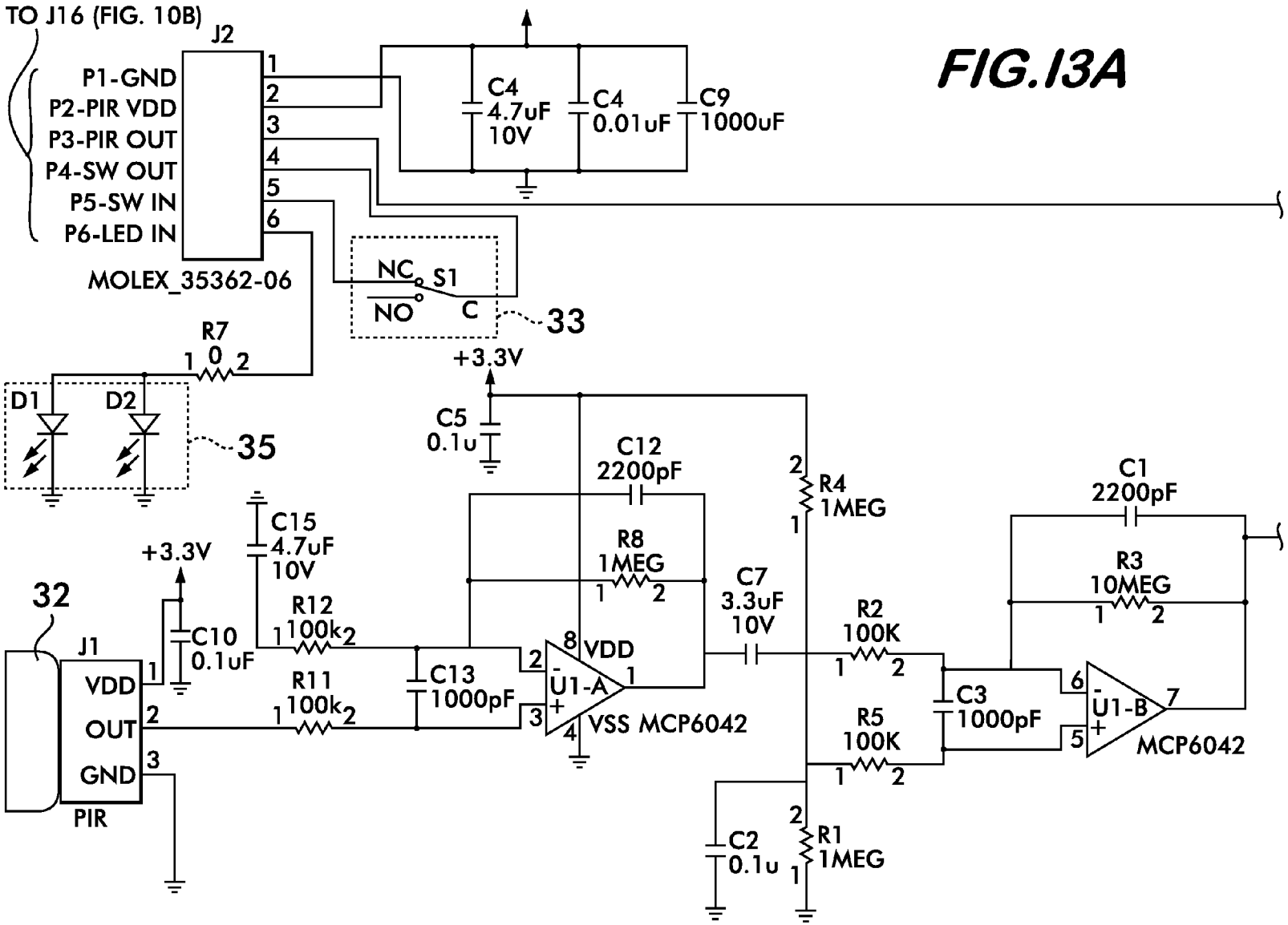
FIGS. 13A-13B together comprise the EAS beacon passive infrared detector (PIR) circuitry.
Figure 13B:
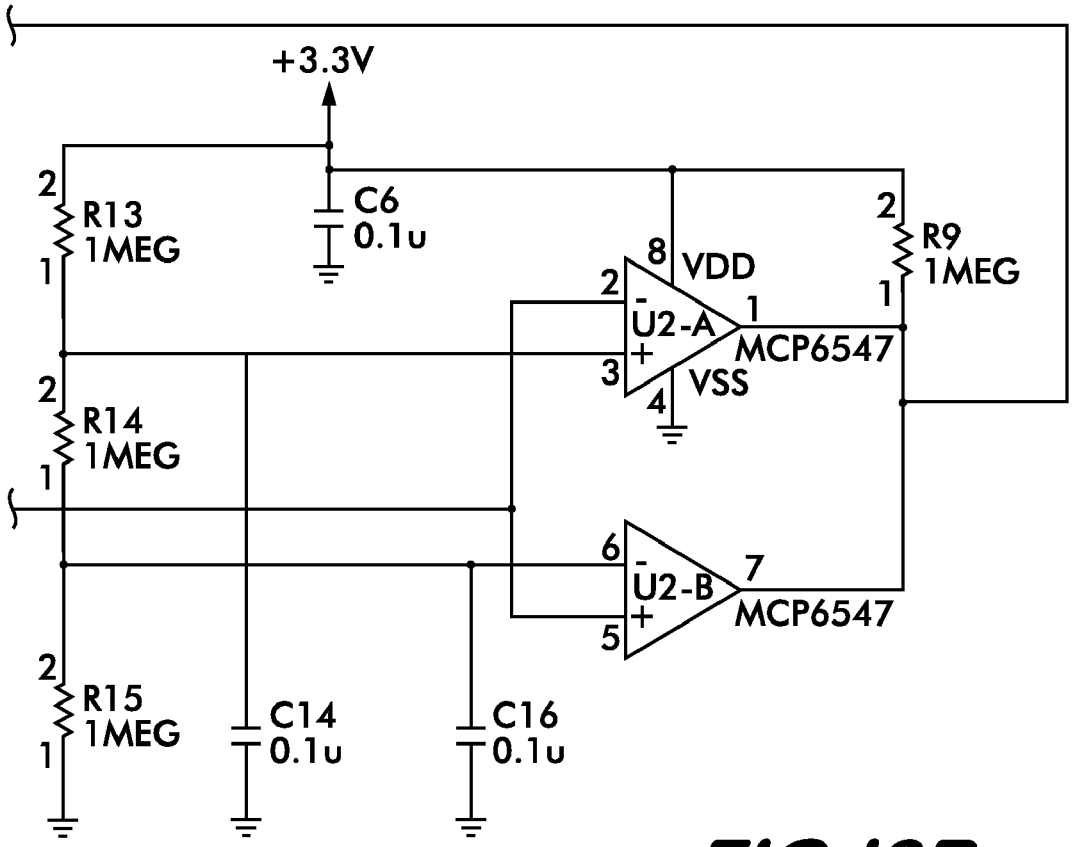

As can be seen from FIG. 13A, the contact switch 33 provides the microcontroller MC to the fact that the EAS beacon 20 has been flexed, pivoted, or removed or is being removed from the surface to which it is attached. In addition, two LEDs D1 and D2 form an "EAS beacon status indicator" 35. This indicator 35 is shown also in FIGS. 1 and 2 and informs store personnel whether the EAS beacon 20 is operating properly or not. For example, the indicator 35 may blink every, e.g., 10, seconds to indicate normal operation whereas if the EAS beacon 35 is not operating properly or if the batteries B1-B6 require replacement, the indicator 35 may blink every e.g., one second.

When the EAS beacon 20 powers up, the microcontroller MC turns on the field oscillator OSC (FIG. 10A, e.g., 8.2 MHz oscillator, such as the LTC6900) as well as a boost enable which ensures that the batteries (when operating the EAS beacon 20) are providing 12 VDC (otherwise the oscillator OSC may fade out) as the batteries B1-B6 age and their voltage falls off from the nominal 9 VDC to 4 VDC. Thus, once the boost is initiated and the oscillator OSC has had a chance to lock in and settle, the gate signature bins (as will be discussed below) are then transmitted. After the last bin is transmitted, the oscillator OSC is powered down, the boost is shut off and the electronics prepares for another cycle.

Figure 15:
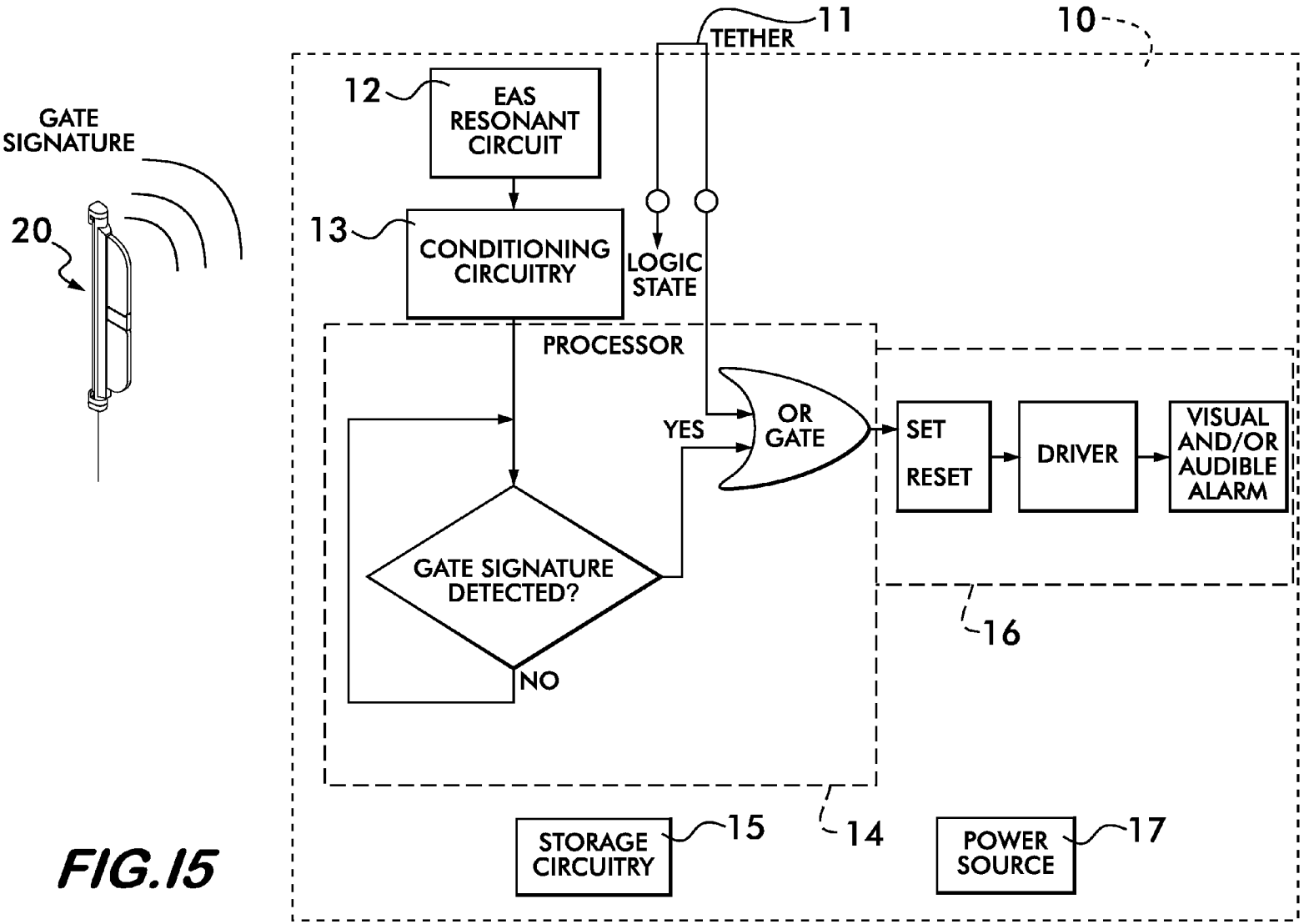
FIG. 15 is a block diagram of an exemplary security tag transponder of the present invention.

Based on the foregoing, the following is a description of the how the EM field 60 (FIG. 7) is generated. As mentioned earlier, the EM field 60 is formed by driving the coils 24A/24B 180° out of phase with respect to each other. FIG. 15 depicts the EM field 60 activation for each coil 24A/24B which, as can be seen, is not a continuous emission but operates on a duty cycle. In particular, the EAS beacon 20 transmits a "field frame" every 100 msec. Each field frame comprises a plurality (e.g., 15) of field bins wherein each field bin comprises two bursts of field frequency (e.g., 8.2 MHz) separated by a gap of 64 μsec, with each burst comprising approximately 6 μsec. As mentioned earlier, it should be understood that the field frequency of 8.2 MHz is shown by way of example only and that other security system frequencies (e.g., 13.56 MHz, 900 MHz, 2.4 GHz, etc.) may be used. The security tag transponder 10 detects these field frames and if the security tag transponder 10 detects a predetermined number of field bins (e.g., 71 bins) within a second, hereinafter referred to as the "gate signature", the transponder 10 concludes that it is within the EM field 60. Depending on the configuration of the security system (described in detail below), the transponder 10 will either alarm or remain silent. If, on the other hand, the transponder 10 fails to detect the predetermined number of field bins within a second, the transponder 10 resets and awaits a new count. The range of the EM field 60 is approximately 1 meter.

Operation of various exemplary anti-theft systems using the EAS beacon 20 are now discussed.

Figure 7:
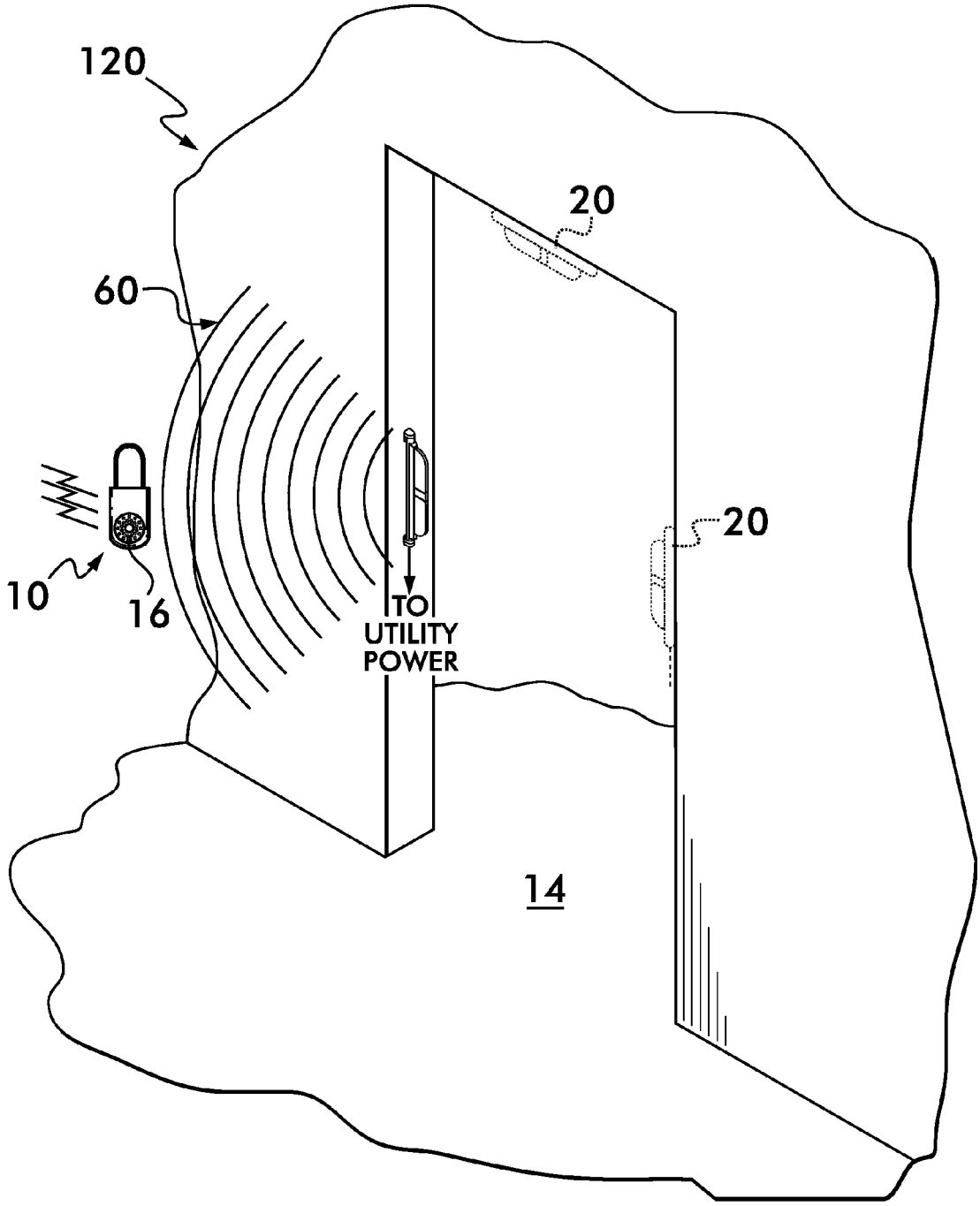
FIG. 7 depicts a first system configuration showing the security tag alarming when it detects the EAS beacon field, with alternative locations of the EAS beacon being shown in phantom.
Figure 8:
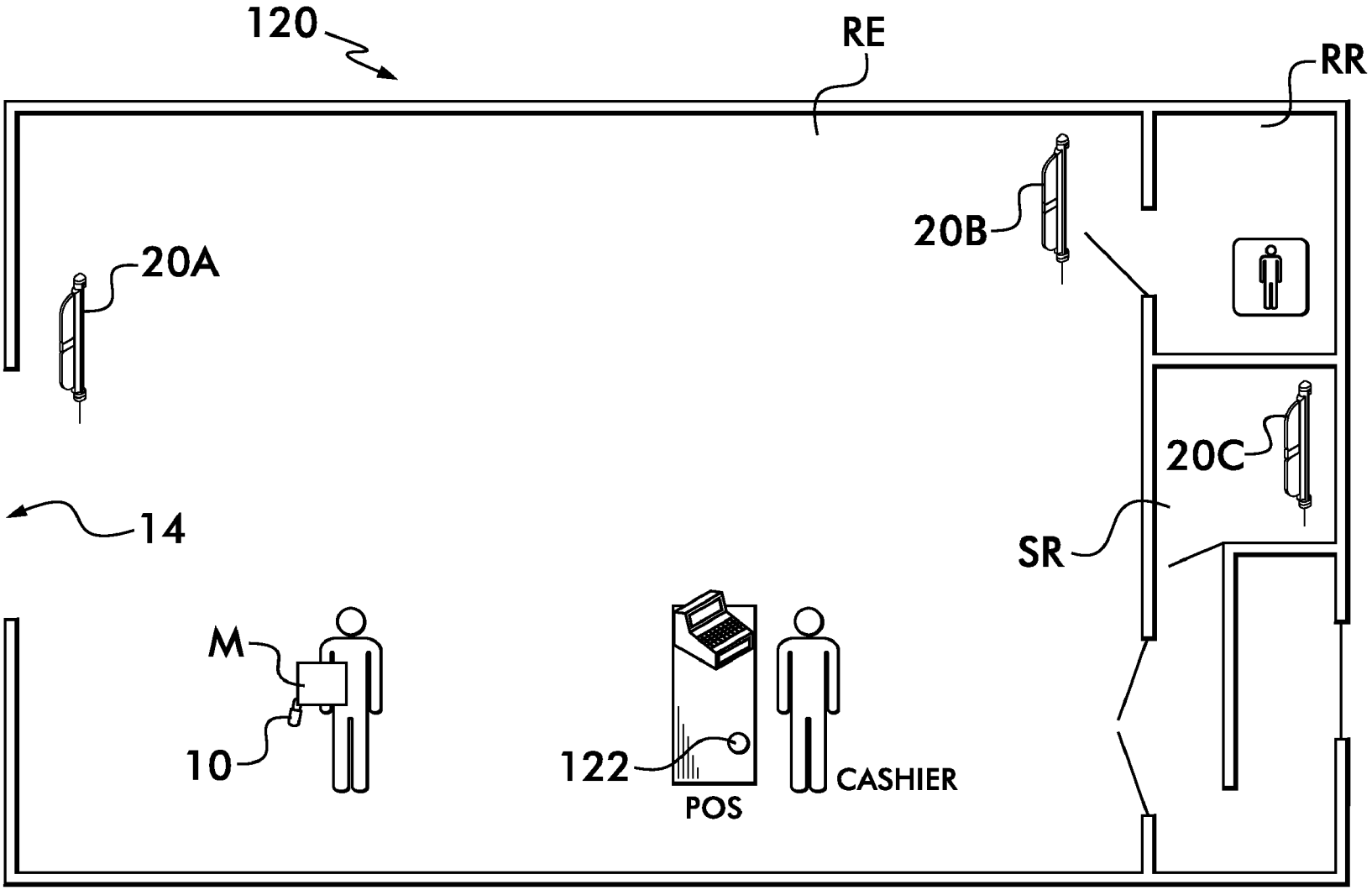
FIG. 8 is a functional diagram of the first system configuration showing a plurality of EAS beacons installed within a retail environment.

FIGS. 7-8 depict an exemplary first configuration of an anti-theft system 120 that uses the EAS beacon 20 and a security tag transponder 10. The security tag transponder 10 includes onboard alarms 16 that are activated when the electromagnetic field of the EAS beacon 20 is detected by the security tag transponder 10. Examples of such security tag transponders 10 include 3-Alarm tags sold by Checkpoint Systems, Inc. (e.g., Alpha "Spider Wrap", Alpha "Cable Sports Tag", Alpha Mini Hard Tag, Alpha "Cable Loks", Alpha "Keeper", etc.). By way of example only, the security tag transponder 10 shown in FIG. 7 comprises locking means for being associated with an article of merchandise M, e.g., being detachably affixed to the article of merchandise M and comprises associated electronics for detecting the EM field of the EAS beacon 20 and for activating or deactivating an audible alarm and/or a visual alarm 16 based thereon. Again, by way of example only, a tether 11 may be used for detachably affixing the transponder 10 to the merchandise M. U.S. Pat. No. 7,474,215 (Scott, et al.), which is owned by the same Assignee as the present invention, namely, Checkpoint Systems, Inc. and whose entire disclosure is incorporated by reference herein, provides an example of the security tag transponder 10 and to which FIG. 16 of the present application corresponds. In particular, the transponder 10 may comprise an EAS resonant circuit 12 (e.g., an LC resonant circuit), conditioning circuitry 13, a processor 14, storage circuitry 15 and onboard alarm circuitry 16; an onboard power source 17 is also included. The conditioning circuitry 13 may comprise detection circuitry, amplifiers and pulse shapers for assisting the processor 14 in detecting the gate signature. As shown in FIG. 15, this tether 11 is interfaced with the transponder 10 such that severing the tether 11 (e.g., thereby changing a logic state) will be detected and activation of the onboard alarms 16 will occur. In addition, if the security tag transponder 10 detects the "gate signature", this will cause the onboard alarms 16 to trigger.

It should be noted that an alternative to the locking means includes tamper resistance as taught in U.S. Provisional Patent Application 61/057,604 (Conti, et al.) entitled "Self-alignment Bayonet Cable-Lock Closure," wherein there are two tiers of locking whereby, if the first tier lock is breached by tampering, an alarm sounds while a second tier lock still affixes the alarm device to the merchandise. This has the advantage that the thief cannot be rid of the alarm by merely breaching the first tier lock. Rather the thief must carry the still-alarming device with him if he wishes to depart the retail facility with the merchandise.

FIG. 8 is a functional diagram of the first configuration 120 in an exemplary retail environment RE. A cashier has access to a secure detacher 122 for detaching the security tag transponder 10 from its associated article or merchandise M. The shopper has free access to the merchandise M but cannot remove the security tag transponder 10. In this security zone configuration, if the shopper attempts to take the merchandise out of the retail entrance 14, the security tag transponder 10 will alarm due to the presence of beacon 20A, as discussed previously with regard to FIG. 7. If the shopper attempts to take the merchandise M to a restroom RR for privacy in trying to remove the security tag transponder 10, again the transponder 10 will alarm due to the presence of the beacon 20B. Furthermore, if retail staff attempt to bring merchandise M into the back staff room SR, the transponder 10 will alarm due the presence of the beacon 20C.

Figure 9:
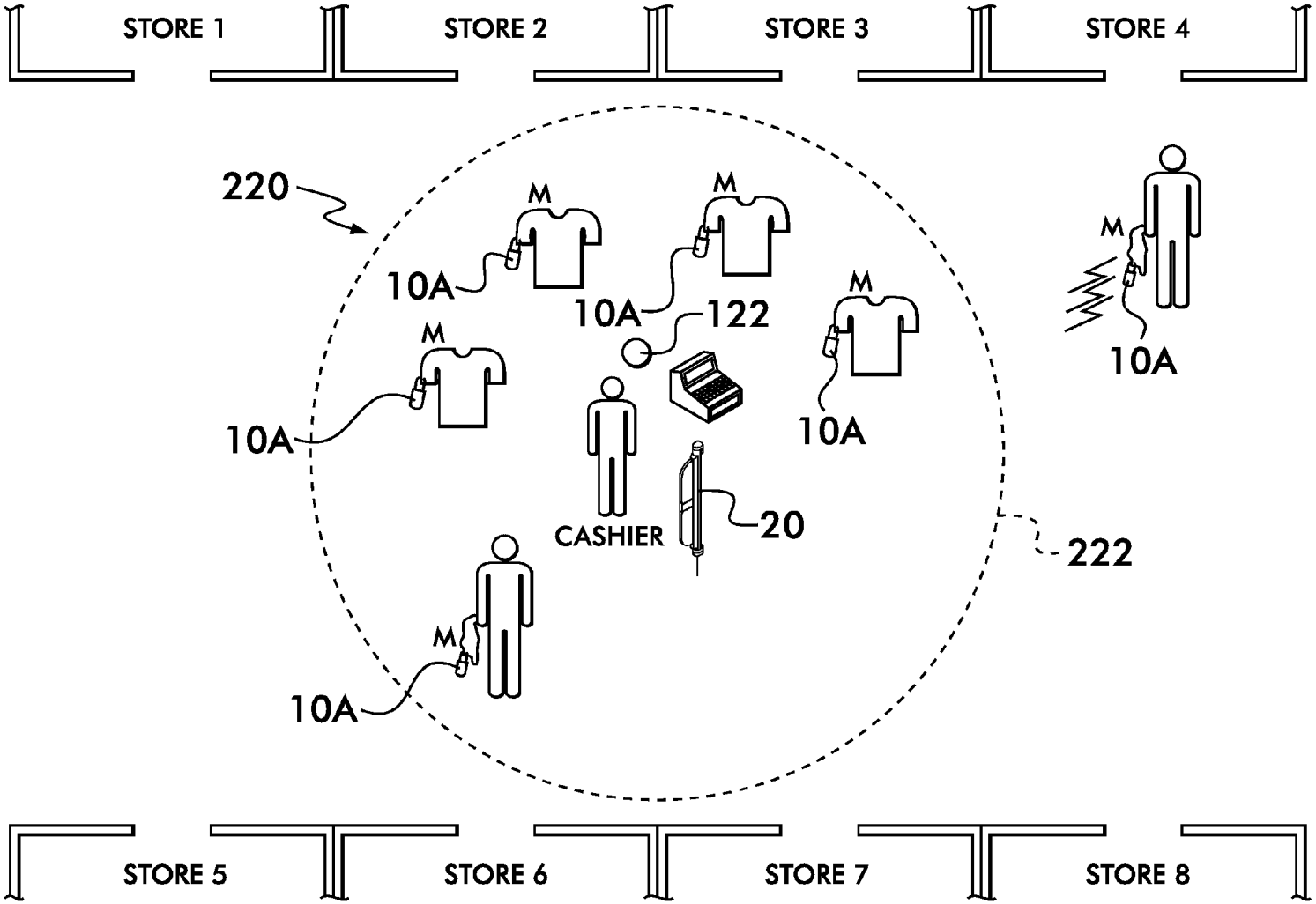
FIG. 9 is a functional diagram of a second system configuration showing implementation of an EAS beacon in an open area of a mall where merchants have stands or kiosks, etc.

FIG. 9 depicts a second exemplary configuration of an anti-theft system 220 wherein as long as the security tag transponder 10A is detecting the EM field of the EAS beacon 20, the onboard transponder alarms 16 remain deactivated. In particular, a merchant may set up a stand or kiosk in the open area (e.g., a hallway or atrium) of a mall with stores located on either side. Such a sales environment has no walls to constrict the open flow of shopper movement and merchandise M is arranged for open interaction with the shopper. To prevent theft of merchandise from such a retail environment, in this security zone configuration, the security tag transponders 10A are configured to operate in the opposite manner as they do in the first configuration 120, namely, as long as the transponders 10A are detecting the EM field of an EAS beacon 20 positioned at the stand or kiosk, the transponder alarms 16 remain silent. However, once the security tag transponder 10A and its associated merchandise M arrives outside the reach 222 of the EM field of the EAS beacon 20, the alarms of the transponder 10A are activated. Only the valid purchasing of the merchandise M will result in the cashier removing the security tag transponder 10A from the merchandise M and permit the shopper to depart the kiosk vicinity with the merchandise M.

As with the first configuration, tampering with the tether 11 of transponder 10A will result in the activation of the onboard alarms 16.

Improper interaction between adjacent anti-theft systems 220 can be avoided by programming the EAS beacons 20 and security tag transponders 10A with identifiers unique to each kiosk/stand. The advantage of this second configuration (also referred to as a "wireless corral") is that trying to steal a protected item by placing it in foil-lined bag results in the onboard alarms being set off since the transponder 10A can no longer "hear the EAS beacon." Another alternative of this second configuration is referred to as a "wireless lanyard" wherein the security tag transponder 10A does not stay latched in an alarm mode when merchandise M is removed from a kiosk or section of the store; rather the onboard alarms 16 will shut off if returned.

It should be understood that smaller versions of the systems 120/220 are within the broadest scope of the present invention and which appeal greatly to retail facilities which previously have avoided the use of EAS systems because of installation, calibration, and maintenance costs. In a minimum anti-theft system, a retail facility need only be equipped with EAS beacons 20 and associated security tag transponders responsive thereto. Such could be provided in a kit ready for use with essentially no installation required. In another variation of the minimum configuration, an EAS beacon 20 may be configurable to act as a security tag transponder programmer or as an alarm disabling key as required. These minimum systems can be referred to as "EAS in a box" because all the necessary components can fit in a single box that one person can handle, and require no installation wiring, tools, calibration, etc. Users can establish an alarm system without any outside assistance.

It should be understood that 8.2 MHz EAS beacon frequency disclosed in the present application is by way of example only and is not meant, in any way, to limit the operation of the EAS beacon 20 or the related anti-theft systems 120 and 220. For example, the EAS beacon 20 can be operated using 13.56 MHz, or using ISM band frequencies (e.g., 900 MHz, 2.45 GHz, including Bluetooth operation, 2.5 GHz, etc.) in accordance with IEEE 802.15.4 protocol or IEEE 802.11 protocol. Operation in these ISM band frequencies would require proper filtering and detection schemes to avoid interference by local wireless networks and cellular phone operation. U.S. Pat. No. 7,474,215 (Scott, et al.), whose entire disclosure is incorporated by reference herein, discloses solutions for similar ultra high frequency operation.

Figure 16:
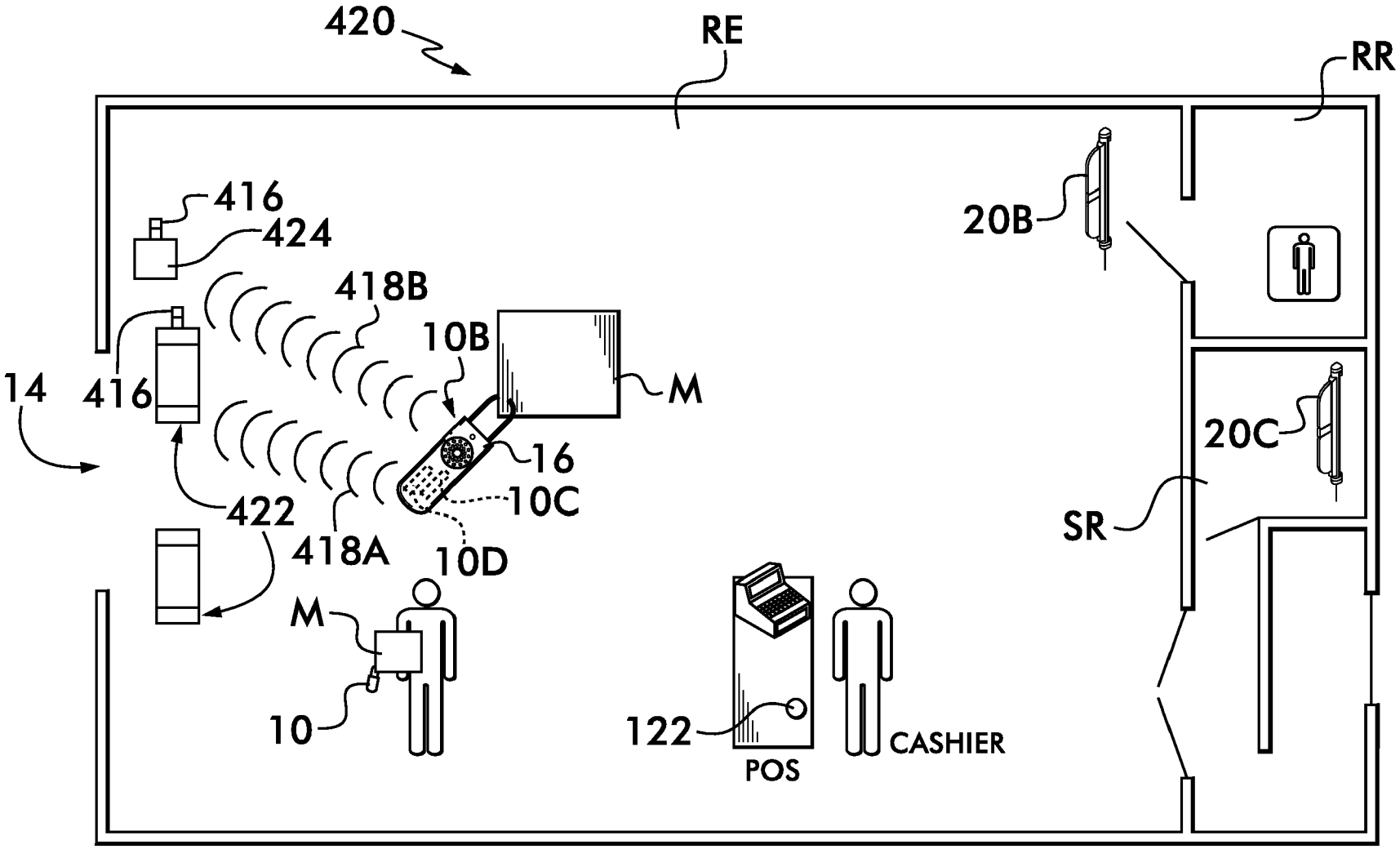
FIG. 16 is a functional diagram of a hybrid anti-theft security system that uses the EAS beacon and security tag transponder along with conventional EAS pedestals and/or RFID readers.

As mentioned earlier, the preferred embodiment of the present invention is to have the EAS beacon 20 work within existing EAS and/or RFID anti-theft security systems to, among other things, extend security zones. For example, FIG. 16 depicts such a "hybrid" system 420 in which the security tag transponder 10B includes an EAS element 10C and/or and RFID element 10D (e.g., passive elements that are powered by the fields to which they are subjected); thus, the security tag transponder 10B includes all of the content of the previously discussed transponders 10 and 10A but also includes the EAS element 10C and RFID element 10D. The EAS element 10C may comprise any known coil/capacitor resonant circuit (e.g., U.S. Pat. No. 5,754,110 (Appalucci, et al.) and whose entire disclosure is incorporated by reference herein) and the RFID element may comprise any known RFID integrated circuit and antenna (e.g., dipole antenna), such as those that comply with EPC Radio-Frequency Identity Protocols, Class-1 Generation UHF RFID Protocol for Communications at 860 MHz-960 MHz. In addition, a pair of EAS pedestals 422 (e.g., the EVOLVE P10/P20 pedestals by Checkpoint Systems, Inc.) or an RFID reader 424 (e.g., any RFID reader that complies with the EPC RFID standard mentioned previously) are positioned at the entrance 14 of the retail environment RE instead of the EAS beacon 20 and they emit a corresponding electromagnetic field (EM, also referred to an as "interrogation signal") (not shown) to which the EAS element 10C or the RFID element 10D are tuned. The EAS pedestals 422 or RFID reader 424 include alarms 416 (visual and/or audible) that are activated upon their respective receivers detecting a reflected signal 418A or 418B from the EAS element 422 or the RFID element 424 in response to the corresponding EM field; where an RFID reader is used, the reflected signal 418B also includes transponder data. Thus, by way of example only, if the security tag transponder 10B enters the EM field of the EAS beacon 20, the alarm 16 will activate; if, on the other hand, the security tag transponder 10B enters the EM field of the EAS pedestals 422 or the RFID reader 424, the EAS pedestal or RFID alarm 416 will activate. In addition, if the EAS element 10C, the EAS pedestals 422 and the EAS beacon 20 are tuned to the same frequency, if the security tag transponder 10B were to enter the EM field of the EAS pedestals 422, both the alarms 16 on the security tag transponder 10 and the EAS pedestal alarm 416 will activate.

It should be further noted that where existing EAS antitheft security systems that utilize security tag transponders 10 or 10A, the EAS beacon 20 operates such it emulates a traditional gate pattern which allows the same security tag transponder 10/10A hardware/firmware to be used as is already used in existing EAS installations. Thus, the EAS beacon 20 can be used to extend security zones.

It should be further understood that combination EAS/RFID systems can be used together with the EAS beacon 20 rather alternatively such as those disclosed in U.S. Pat. No. 7,184,804 (Salesky, et al.) entitled "System and Method for Detecting EAS/RFID Tags Using Step Listen", as well as combination EAS/RFID security tags as disclosed in U.S. Patent Publication No. 2008/0150719 (Cote, et al.), entitled "EAS and UHF Combination Tag" and both of whose entire disclosures are incorporated by reference herein.

As with the EAS beacon 20, the EAS pedestals and the RFID readers and corresponding EAS elements/RFID elements are not limited to a particular frequency of operation and may operate different frequency bands. By way of example only, the EAS pedestals/elements may operate at 6.78 MHz, 7.2 MHz, 8.2 MHz, etc. and the RFID reader/elements may operate 2-14 MHz, 850-960 MHz, 2.3-2.6 GHz. Operation in ISM band frequencies (e.g., 900 MHz, 2.45 GHz, including Bluetooth operation, 2.5 GHz, etc.) is in accordance with IEEE 802.15.4 protocol or IEEE 802.11 protocol. Operation in these ISM band frequencies would require proper filtering and detection schemes to avoid interference by local wireless networks and cellular phone operation. U.S. Pat. No. 7,474,215 (Scott, et al.), whose entire disclosure is incorporated by reference herein, discloses solutions for similar ultra high frequency operation.

While the invention has been described in detail and with reference to specific examples thereof, it will be apparent to one skilled in the art that various changes and modifications can be made therein without departing from the spirit and scope thereof.

What is claimed is:

1. An antitheft security system, said system comprising:

an electromagnetic (EM) field generator, said EM field generator comprising a housing to which at least one antenna is coupled thereto, said at least one antenna generating said EM field of a predetermined frequency, said housing being securable to a surface or surfaces in a plurality of orientations; and at least one security tag comprising a circuit tuned to said predetermined frequency, a detector and an alarm, said detector detecting said EM field received by said circuit and either activating said alarm or maintaining said alarm in a deactivated condition depending upon a security zone configuration of said antitheft security system;

wherein said housing comprises an elongated housing having a longitudinal axis and first and second ends located at opposite ends of said longitudinal axis, wherein said first and/or second ends of said elongated housing comprise an electrical port for coupling to an external power source;

wherein said EM field generator further comprises an internal power source, said EM field generator comprising means for automatically switching between power provided from said external power source and from said internal power source with no loss of operation of said EM field generator during switching;

the antitheft security system further comprising a passive infrared sensor (PIR) for detecting motion around said EM field generator when said EM field generator is being powered from said internal power source, said PIR causing said field generator to switch to a low power "sleep state" when there is no motion being detected; and wherein said PIR is automatically deactivated when said EM field generator is being powered from said external power source.

2. The antitheft security system of claim 1 wherein said security zone configuration of said antitheft security system comprises mounting said EM field generator at a portal whereby the security tag is moving from an enclosed location to an open location or vice versa, said alarm being activated when said security tag receiver detects said EM field.

3. The antitheft security system of claim 1 wherein said security zone configuration of said antitheft security system comprises a zone defined by the EM field generated by said EM field generator, said security tag alarm remaining silent as long as said security tag receiver detects said EM field.

4. The antitheft security system of claim 1 wherein said housing can be flexed when a force is applied to said at least one antenna.

5. The antitheft security system of claim 4 wherein said elongated housing can pivot about said longitudinal axis when said force is applied to said at least one antenna.

6. The antitheft security system of claim 5 wherein each of said first and second ends comprise springs that restore said housing to a preferred orientation once said applied force is removed.

7. The antitheft security system of claim 4 further comprising an antenna housing alarm which activates when said antenna housing alarm detects the flexing of said housing or any tampering with said housing that would displace said housing from said surface.

8. The antitheft security system of claim 7 wherein said antenna housing alarm comprises a delay means for delaying an initiation of said antenna housing alarm for a configurable amount of time to avoid nuisance trips.

9. The antitheft security system of claim 7 wherein said antenna housing alarm comprises timing means for deactivating said antenna housing alarm after a configurable amount of time.

10. The antitheft security system of claim 1 wherein said EM field generator generates said EM field through the use of intermittent pulse patterns for reducing power consumption by said EM field generator and said at least one tag.

11. A method for establishing an antitheft security system, said method comprising:

generating an electromagnetic (EM) field of a predetermined frequency by energizing at least one antenna that is coupled to a power source and wherein said at least one antenna is coupled to a housing that is securable to a surface or surfaces in a plurality of orientations;

coupling a security tag to an item of merchandise, said security tag comprising a circuit tuned to said predetermined frequency and a detector;

permitting said security tag to encounter said EM field; and detecting, by said detector, said EM field encountered by said circuit of said security tag;

wherein the step of generating an EM field comprises providing an electrical port in at least two different locations on said housing for permitting said housing to be oriented in said plurality of orientations; and wherein said step of generating an EM field comprises including an internal power source and wherein said step of generating an EM field comprises automatically switching between power provided by said external power source and by said internal power source;

the method further comprising step of reducing the power provided to said at least one antenna to a low power "sleep state" whenever there is no motion being detected in the vicinity of said EM field;

wherein said step of reducing the power utilizes a passive infrared sensor (PR) that is deactivated when said external power source is providing power.

12. The method of claim 11 wherein said security tag comprises an alarm and wherein said method further comprises activating said alarm when said detector detects said EM field.

13. The method of claim 11 wherein said security tag comprises an alarm and wherein said method further comprises activating said alarm when said detector no longer detects said EM field.

14. The method of claim 11 further comprising the step of permitting said housing to flex when a force is applied to said at least one antenna.

15. The method of claim 14 wherein said step of permitting said housing to flex comprises pivoting said housing about a longitudinal housing axis.

16. The method of claim 15 wherein said step of pivoting said housing about a longitudinal axis comprises biasing opposite ends of said housing springs such that said springs restore said housing to a preferred orientation once said force is removed.

17. The method of claim 14 further comprising the step of setting off a housing alarm whenever said housing is flexed.

18. The method of claim 17 wherein said step of setting off a housing alarm comprises delaying an initiation of said housing alarm for a configurable amount of time to avoid nuisance trips.

19. The method of claim 17 wherein said step of setting off a housing alarm is deactivated after a configurable amount of time.

20. The method of claim 11 wherein said step of generating said EM field comprises emitting intermittent pulse patterns for reducing power consumption by said EM field and by said security tag.

* * * * *

UNITED STATES PATENT AND TRADEMARK OFFICE

CERTIFICATE OF CORRECTION

PATENT NO. : 8,378,823 B2
APPLICATION NO. : 12/771510
DATED : February 19, 2013
INVENTOR(S) : Lee Eckert et al.

It is certified that error appears in the above-identified patent and that said Letters Patent is hereby corrected as shown below:

In the Claims:

Column 15, line 13 "infrared sensor (PR)" should be changed to --infrared sensor (PIR)--

Signed and Sealed this
Fourth Day of June, 2013

Teresa Stanek Rea
*Acting Director of the United States Patent and Trademark Office*